US012426687B2

(12) United States Patent
Karchon et al.

(10) Patent No.: US 12,426,687 B2
(45) Date of Patent: Sep. 30, 2025

(54) CORD LOCK, WEBBING CLIP, WEBBING HARDWARE OR ZIPPER PULL INCLUDING TRITIUM

(71) Applicant: Sherpa Enterprises, LLC, Dearborn, MI (US)

(72) Inventors: Christopher J. Karchon, Birmingham, MI (US); Alexander J. Karchon, Birmingham, MI (US)

(73) Assignee: Sherpa Enterprises, LLC

( * ) Notice: Subject to any disclaimer, the term of this patent is extended or adjusted under 35 U.S.C. 154(b) by 22 days.

(21) Appl. No.: 18/623,670

(22) Filed: Apr. 1, 2024

(65) Prior Publication Data

US 2024/0324733 A1 Oct. 3, 2024

Related U.S. Application Data

(60) Provisional application No. 63/456,196, filed on Mar. 31, 2023.

(51) Int. Cl.
*A44B 19/26* (2006.01)

(52) U.S. Cl.
CPC ..... *A44B 19/262* (2013.01)

(58) Field of Classification Search
CPC ..... A44B 19/262; A44B 19/24; A44B 19/26
See application file for complete search history.

(56) References Cited

U.S. PATENT DOCUMENTS

2010/0050394 A1* 3/2010 Fried ..... B65D 33/1633 24/114.5

* cited by examiner

*Primary Examiner* — David M Upchurch
(74) *Attorney, Agent, or Firm* — Dickinson Wright PLLC

(57) ABSTRACT

A zipper assembly includes a slider for mating with a meshing together opposing teeth of a zipper. A pull extends from a first end secured to the slider to a second pull end to define an upper pull surface and a lower pull surface disposed in spaced and opposing relationship with one another. At least one tritium vial is housed within or coupled to the pull for allowing illumination produced by said at least one tritium vial to highlight the pull and improve visibility of the zipper assembly, particularly in dark or low-light conditions.

20 Claims, 27 Drawing Sheets

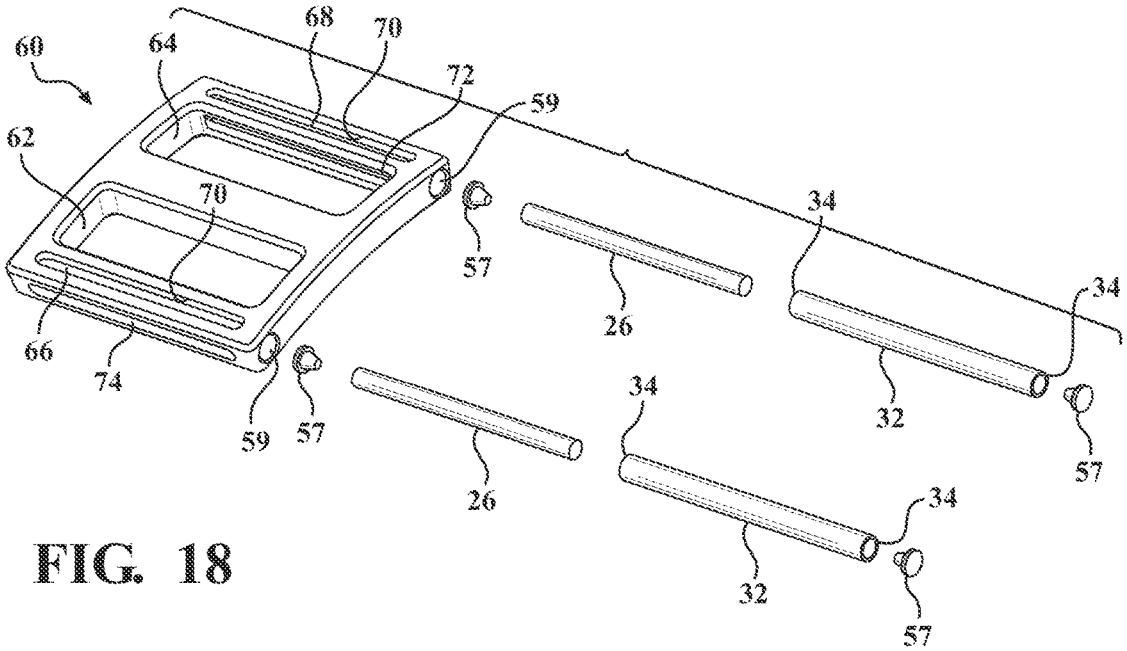
FIG. 18
FIG. 19
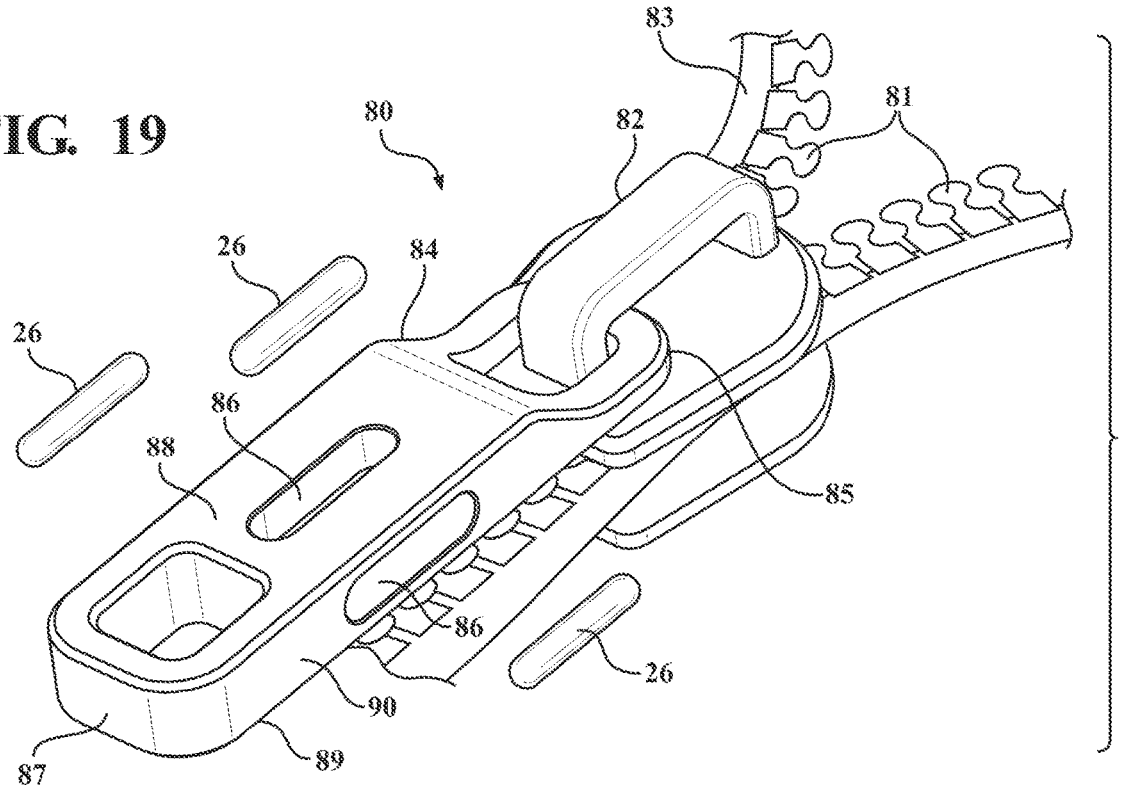

CORD LOCK, WEBBING CLIP, WEBBING HARDWARE OR ZIPPER PULL INCLUDING TRITIUM

CROSS REFERENCE TO RELATED APPLICATION

The subject application claims priority to U.S. Provisional Application Ser. No. 63/456,196 filed on Mar. 31, 2023, the entire disclosure of which is incorporated herein by reference.

FIELD OF THE DISCLOSURE

The present disclosure relates generally to cord locks, webbing clips, webbing hardware and zipper pulls. More specifically, the present disclosure relates to cord locks, webbing clips, webbing hardware and/or zipper pulls which include or incorporate tritium.

BACKGROUND OF THE INVENTION

This section provides a general summary of background information and the comments and examples provided in this section are not necessarily prior art to the present disclosure.

Tritium is a radioactive isotope of hydrogen which can be used as a luminary device for watches, compasses, knives, guns, tools, and the like. Naturally occurring tritium is extremely rare and thus too small for practical recovery. Accordingly, tritium is typically only produced in nuclear reactors and often provided or retained within glass vials. However, the use of tritium in products, such as watches, compasses, knives, guns, tools, and the like, is closely regulated by various U.S. governmental organizations to protect the health and safety of the public and the environment. Toward that end, the use and incorporation of the tritium glass vials into said products is closely regulated by the federal government and any such use must sufficiently establish that the tritium vials are adequately protected from damage or breakage during their regular and everyday use. Absent such proof, the use and incorporation of tritium glass vials into said products is simply not permitted by the various U.S. governmental organizations.

The subject disclosure is directed to aspects of incorporating tritium vials into other products, namely cord locks, webbing clips, webbing hardware and zipper pulls, which are intended to meet these strict federal government regulations while correspondingly providing the aesthetic and luminary benefits which stem from the use of tritium in these products.

SUMMARY OF THE INVENTION

In accordance with an aspect, a zipper assembly includes a slider for mating with and meshing together opposing teeth of a zipper. A pull extends from a first end secured to the slider to a second pull end to define an upper pull surface and a lower pull surface disposed in spaced and opposing relationship with one another. At least one tritium vial is housed within or coupled to the pull for allowing illumination produced by said at least one tritium vial to highlight said pull and improve visibility of the zipper assembly, particularly in dark or low-light conditions.

BRIEF DESCRIPTION OF THE DRAWINGS

The drawings described herein are for illustrative purposes only of selected embodiments and not all possible implementations, and are not intended to limit the scope of the present disclosure.

FIG. 18 is an exploded perspective view of the webbing hardware component incorporating tritium in accordance with a seventh aspect;

FIG. 19 is an exploded perspective view of a zipper assembly incorporating tritium in accordance with a first aspect;

DETAILED DESCRIPTION OF THE ENABLING EMBODIMENTS

Figure 1:
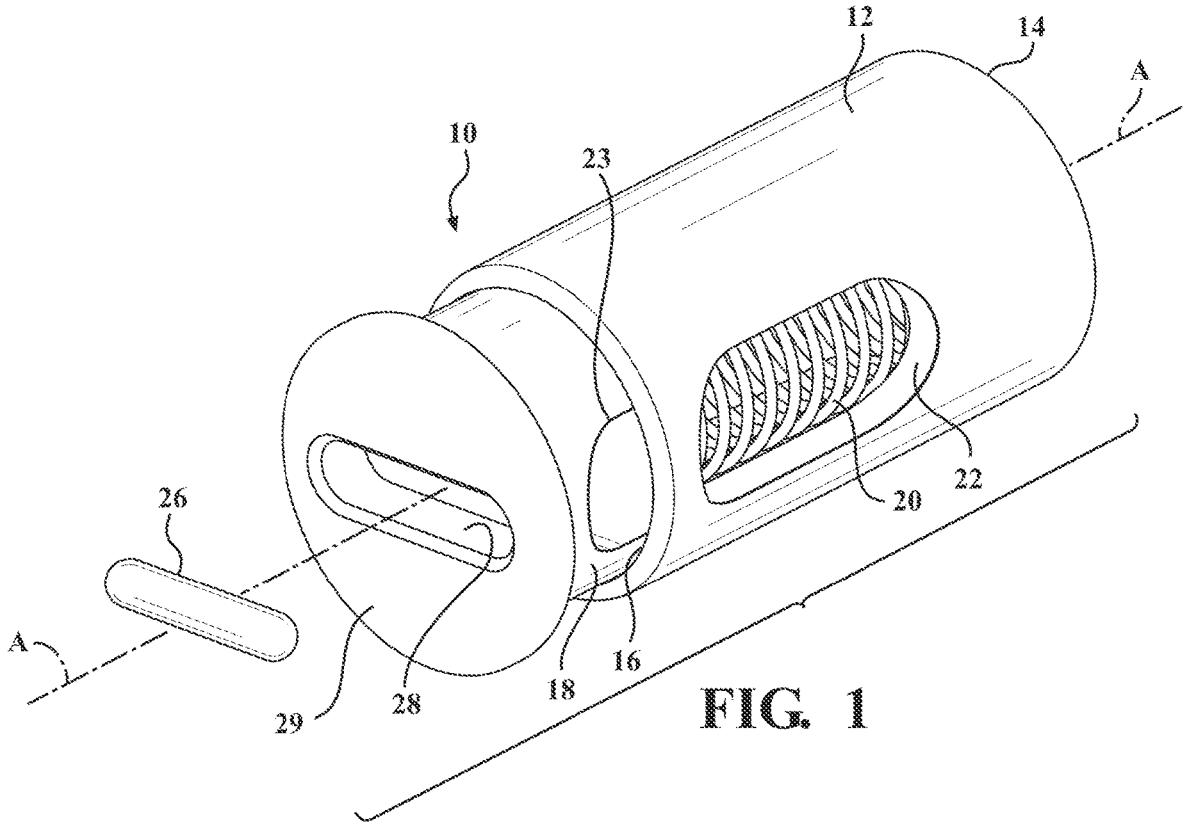
FIG. 1 is an exploded perspective view of a cord lock incorporating tritium in accordance with a first aspect.
Figure 2A:
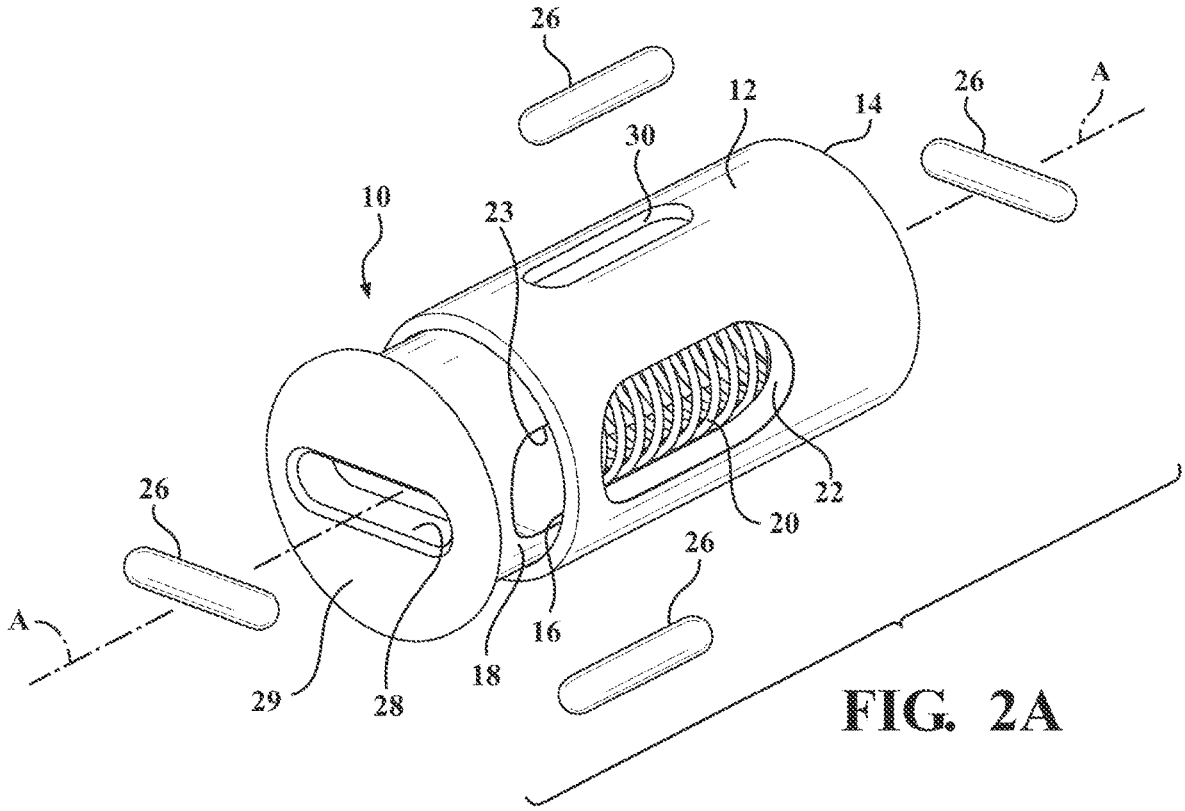
FIGS. 2A-2B are exploded perspective views of the cord lock incorporating tritium in accordance with a second aspect.
Figure 2B:
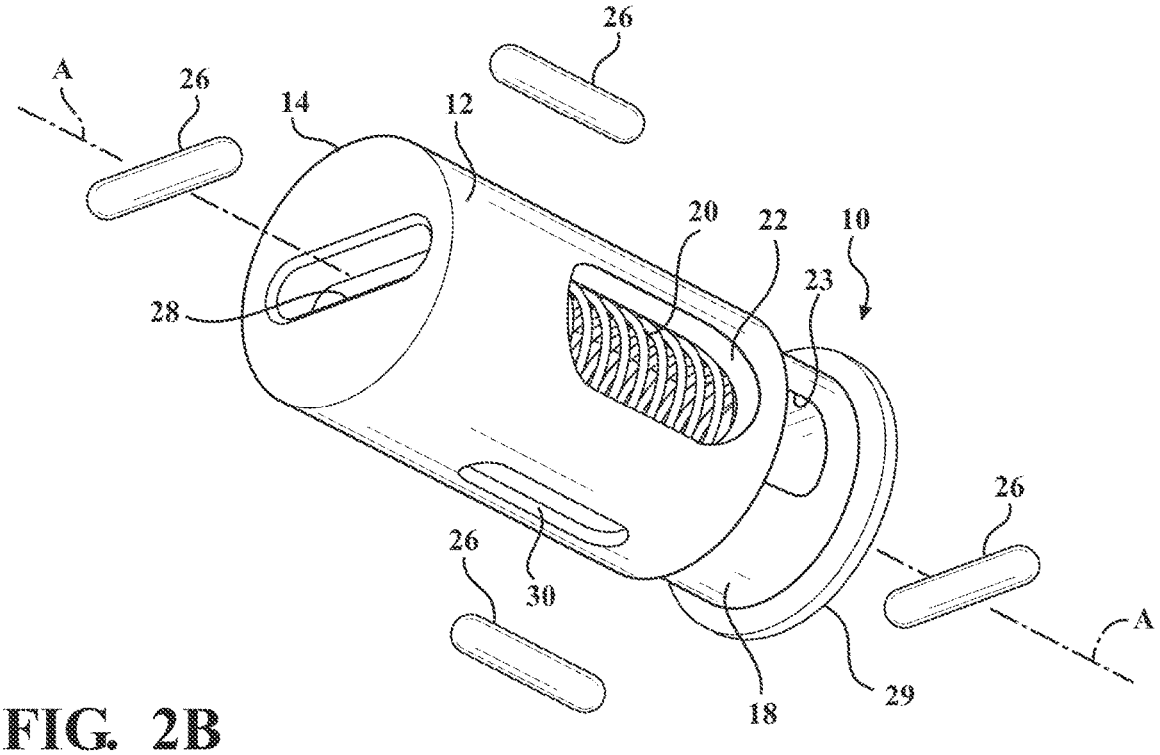

Example embodiments of a cord lock, webbing clip, webbing hardware component and zipper pull which includes or incorporates tritium in accordance with the present disclosure will now be more fully described. Each of these example embodiments are provided so that this disclosure is thorough and fully conveys the scope of the inventive concepts, features and advantages to those skilled in the art. To this end, numerous specific details are set forth such as examples of specific components, devices and mechanisms associated with the cord lock, webbing clip, webbing hardware component and zipper pull to provide a thorough understanding of each of the embodiments associated with the present disclosure. However, as will be apparent to those skilled in the art, not all specific details described herein need to be employed, the example embodiments may be embodied in many different forms, and thus should not be construed or interpreted to limit the scope of the disclosure.

FIGS. 1-6 are exploded perspective views of a cord lock 10 in accordance with various aspects of the subject disclosure. As best shown therein, the cord lock 10 includes a barrel 12 having a generally cylindrical cross-sectional shape and extending along an axis A from a first barrel end 14 to a second barrel end 16. A toggle 18 is slideably disposed within the barrel 12 adjacent the second barrel end 16 and is biased away from the first barrel end 14 via a biasing member 20, such as a spring or the like. The barrel 12 defines a pair of barrel windows 22 disposed in radially aligned relationship with one another, and the toggle 18 defines a pair of toggle windows 23 also disposed in radially aligned relationship with one another. The barrel 12 and toggle 14 are squeezed together by a user, such as via applying a force to an exterior face 29 of the toggle 14, to overcome the biasing force of the biasing member 20 and dispose the barrel and toggle windows 22, 23 in at least partially radially aligned relationship with each other. In this condition, a cord, string, drawstring or the like (not expressly shown) can be passed through the at least partially aligned barrel and toggle windows 23, 23 and mated with the cord lock 10. Put another way, in this compressed relationship of the barrel 12 and toggle 14, the cord lock 10 can freely move along the cord, or vice versa. Once the barrel 12 and toggle 14 are released, the biasing member 20 forces the toggle 14 away from the first barrel end 14 to squeeze or clamp the cord between the barrel 12 and toggle 14 and retain the cord lock 10 in place along the cord.

The cord lock 10 can be used in many different applications to retain the corresponding cord or string in a tightened condition and to release the cord or string when desired. As non-limiting examples, the cord lock 10 can be used in association with apparel that includes drawstrings (e.g., hooded jackets or sweatshirts), various types of bags (e.g., laundry bags, duffel bags or other storage bags that utilize cords or drawstrings to close an open end), camping equipment, and/or on window blinds. In each aspect of the cord lock 10, at least one vial of tritium 26 is housed within the barrel 12 and/or the toggle 18 to allow illumination produced by the tritium vial 26 to highlight the corresponding barrel 12 or toggle 18, and allow the cord lock 10 to be more easily recognized by a user of the cord lock 10, particularly when the cord lock 10 is utilized in dark, night-time, or other low light conditions.

Figure 3:
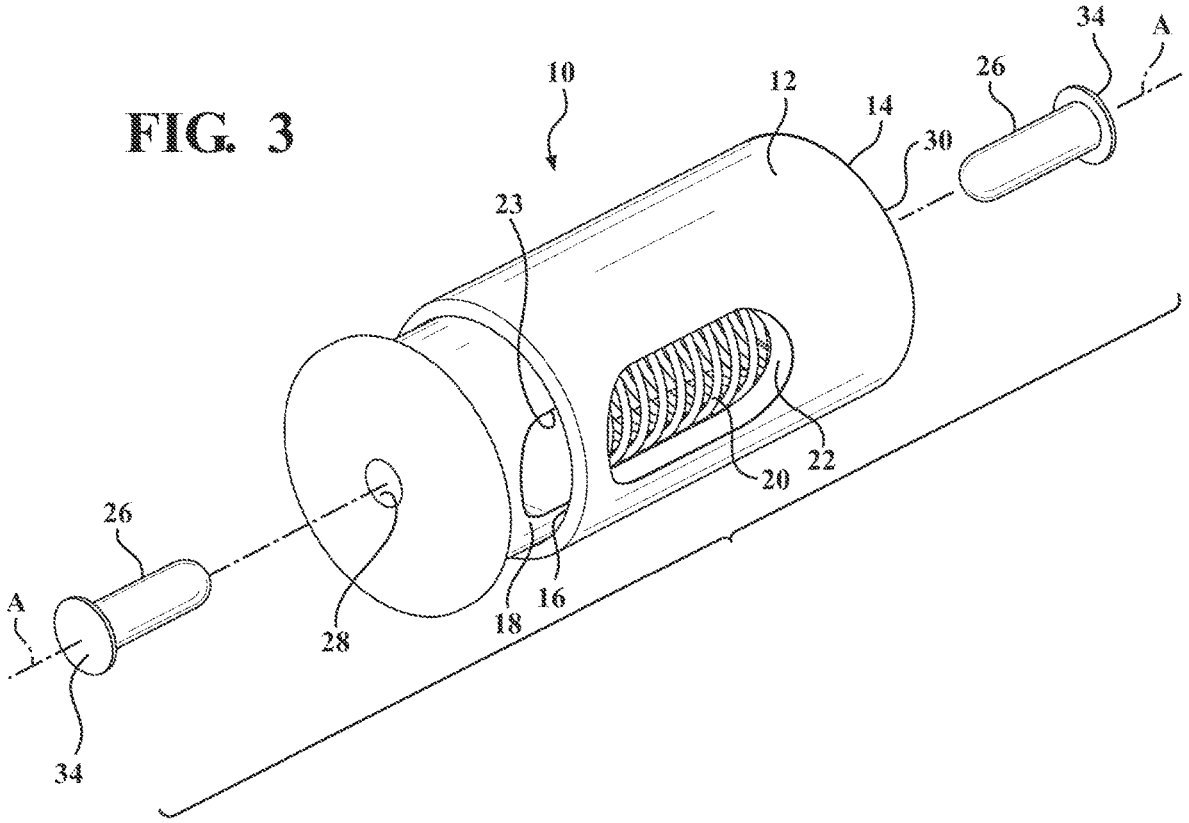
FIG. 3 is an exploded perspective view of the cord lock incorporating tritium in accordance with a third aspect.
Figure 4A:
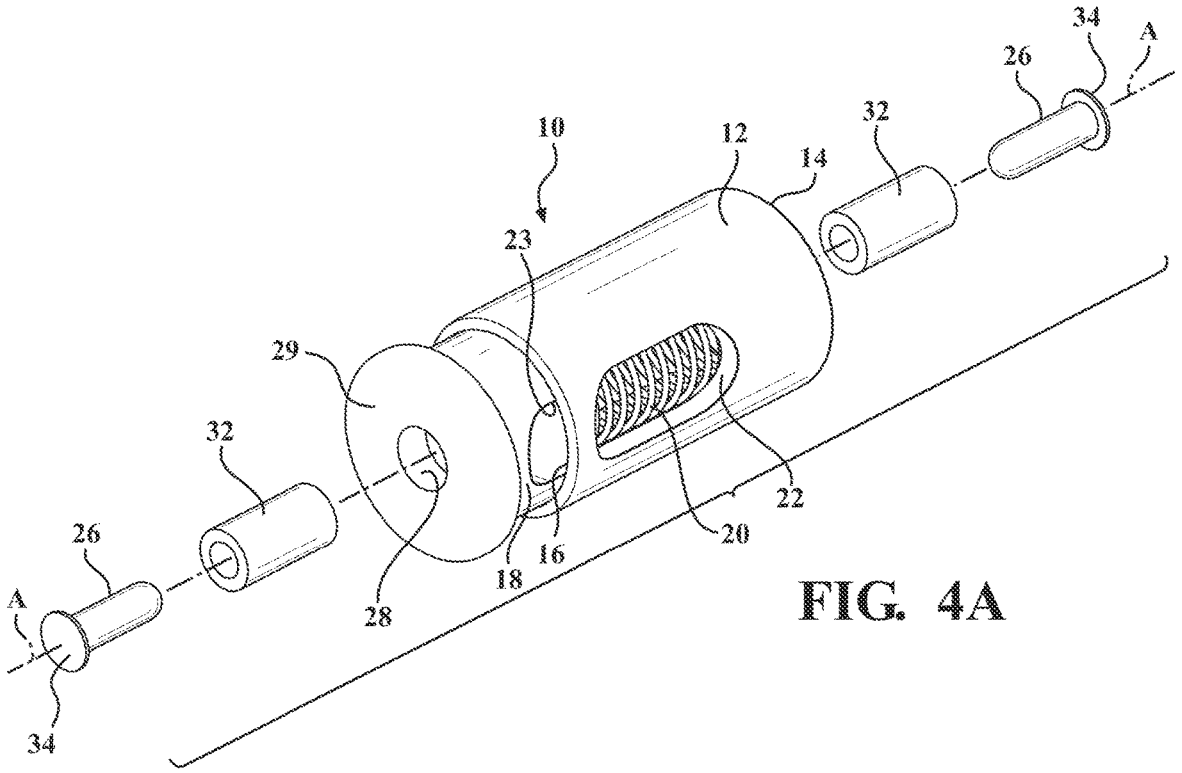
FIGS. 4A-4B are exploded perspective views of the cord lock incorporating tritium in accordance with a fourth aspect.
Figure 4B:
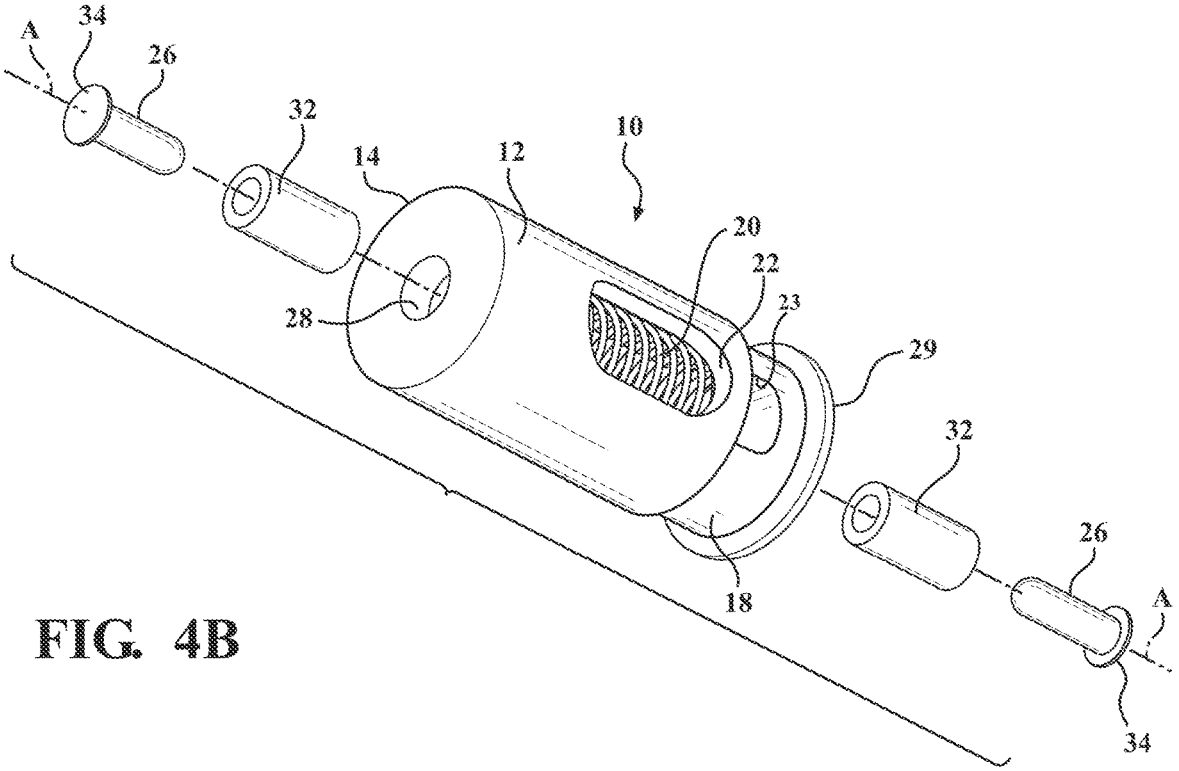

The toggle 18 can define a toggle cavity 28 either extending radially across the exterior face 29 and transverse to the axis A (See FIGS. 1-2A and 5-6) or axially from the exterior face 29 and along the axis A towards the second barrel end 16 (See FIGS. 3 and 4B). Alternatively or additionally, the barrel 12 can define at least one barrel cavity 30 extending axially and in circumferentially spaced relationship with and between the barrel windows 22 (See FIGS. 2A, 2B and 6) or disposed along the first barrel end 14 (See FIGS. 2A-4 and 6), either radially across the first barrel end 14 and traverse to the axis A (See FIGS. 2B and 6) or axially from the first barrel end 14 and along the axis A towards the first barrel end 16 (See FIGS. 3-4). At least one tritium vial 26 is inserted or embedded in each one of the toggle cavities 28 and/or the barrel cavities 30. As previously discussed, the tritium vials 26 are often glass vials and thus susceptible to damage and/or breakage. The disposal of the tritium vial(s) 26 within the toggle cavity 28 and/or the barrel cavity 30 allows the cord lock 10 to provide protection from such damage and/or breakage. Put another way, the cord lock 10 nests or embeds the tritium vial(s) 26 within its barrel and/or toggle cavities 28, 30 to effectively isolate or reduce exposure of the tritium vials 26 to various environmental impacts encountered by the cord lock 10.

Figure 5:
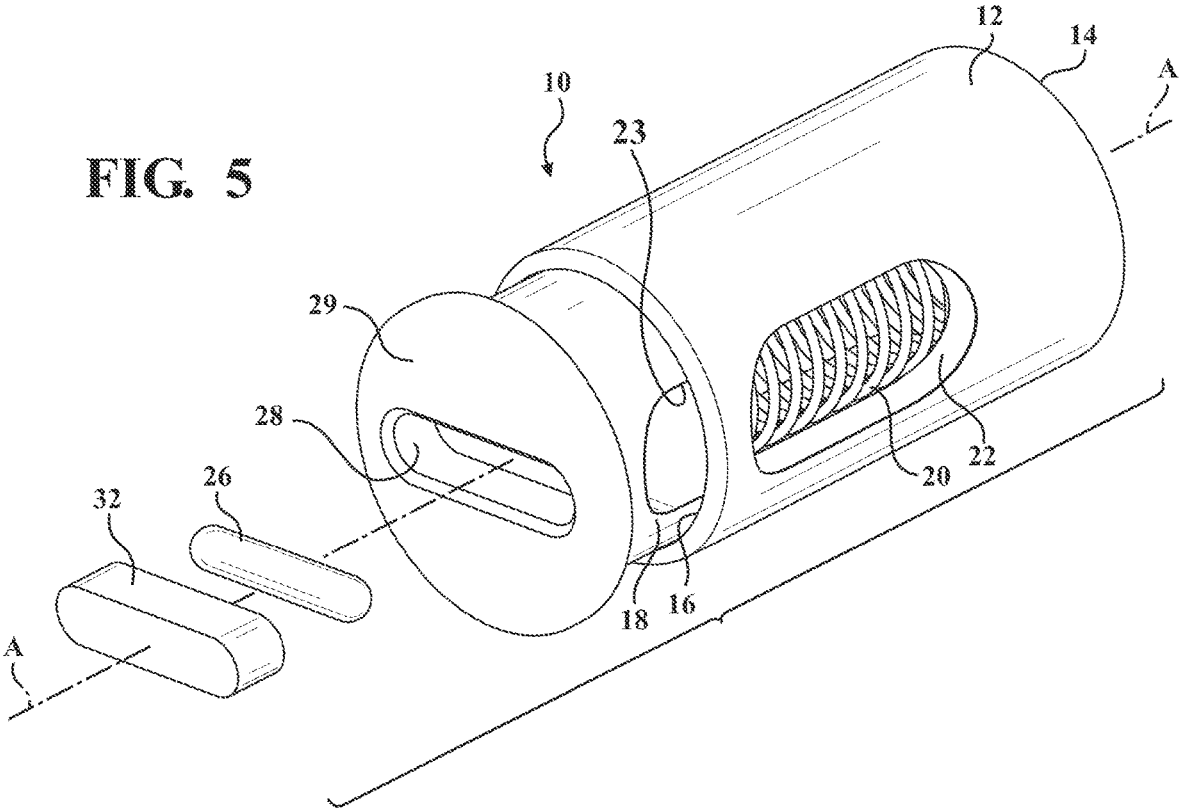
FIG. 5 is an exploded perspective view of the cord lock incorporating tritium in accordance with a fifth aspect.
Figure 6:
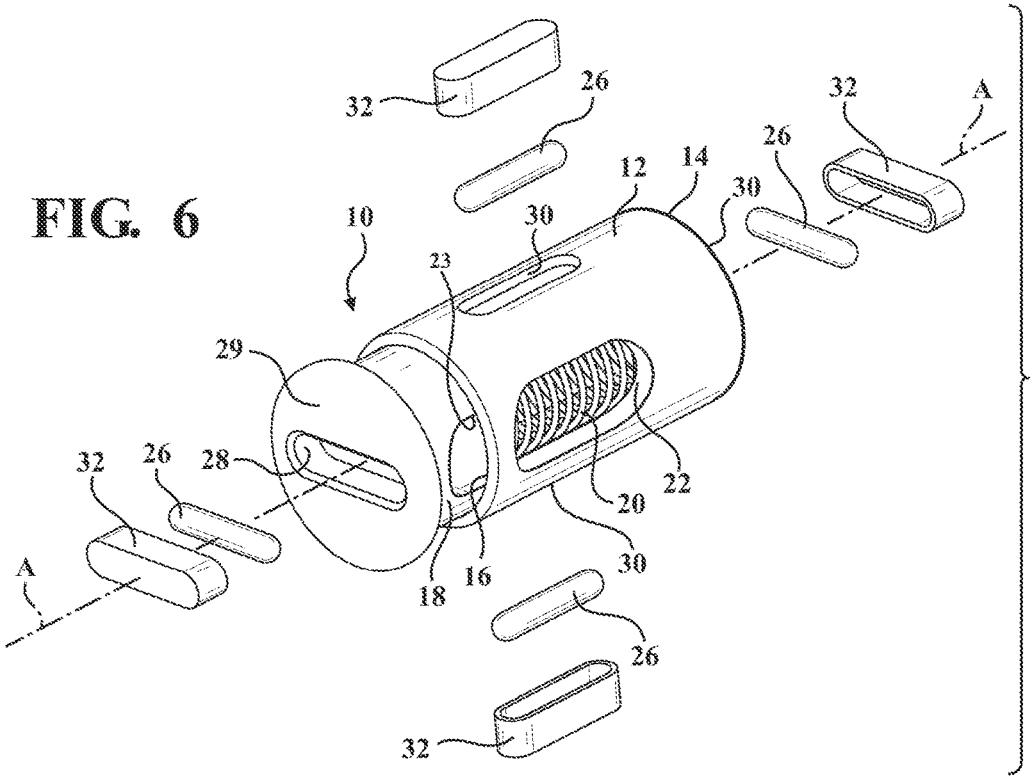
FIG. 6 is an exploded perspective view of the cord lock incorporating tritium in accordance with a sixth aspect.

As illustrated in FIGS. 1-3, the at least one tritium vial 26 can be glued in the toggle cavity 28 and/or the barrel cavity 30. Alternatively, as illustrated in FIGS. 4-6, the at least one tritium vial 26 can be housed or secured within a protective holder 32 which is then inserted or embedded within the toggle cavity 28 and/or the barrel cavity 30 to provide additional protection for the tritium vial 26. Arrangements of the protective holder 32 illustrated in FIGS. 4-6 are described in more detail in Paragraphs [0062-0065] and FIGS. 24-27 of Applicant's U.S. application Ser. No. 17/832,836, the disclosure of which is incorporated herein by reference. In a preferred arrangement the protective holder 32 is comprised of transparent or translucent material, such as an injection molded plastic, for allowing illumination produced by the tritium vial 26 to be viewable by a user through the protective holder 32. However, the protective holder 32 could be comprised of other materials without departing from the scope of the subject disclosure. As best illustrated in FIGS. 3-4, a lens 34 can be micro-molded with the tritium vial 26, particularly when the tritium vial 26 is inserted into a toggle cavity 28 defined by the exterior face 29 of the toggle 18 or a barrel cavity 30 defined by the first barrel end 14 of the barrel 12 to improve visibility of the cord lock 10 from the opposing ends. As will be appreciated by the aforementioned disclosure, in either arrangement, the incorporation of at least one tritium vial 26 into the cord lock 10 provides aesthetic benefits to the cord lock 10 by illuminating the barrel 12 and/or the toggle 18 and allowing a user to see the cord lock 10 at all times.

FIGS. 7-11 are exploded perspective views of a webbing clip 40 in accordance with various aspects of the subject disclosure. As best shown therein, the webbing clip 40 includes a female clip component 42 and a male clip component 44 arranged to be releasably secured with the female clip component 42. Each of the female and male clip components 42, 44 define a through hole 46 extending through the respective components 42, 44 for threadingly receiving a webbing (not expressly shown) to establish a belt-like arrangement for the webbing clip 40 that can be used with backpacks, pouches, clothing (e.g., belts for hiking pants, sport pants, etc.), hanging straps when camping, and dog collars, as non-limiting examples. In each aspect of the webbing clip 40, at least one vial of tritium 26 is housed within the female clip component 42 and/or the male clip component 44 to allow illumination produced by the tritium vial 26 to highlight the male or female clip component(s) 42, 44, and allow the webbing clip 40 to be more easily recognized by a user of the webbing clip 40, particularly when the webbing clip 40 is utilized in dark, night-time, or other low light conditions.

The female clip component 42 can define a female clip cavity 48 and the male clip component 44 can define a male clip cavity 50 each extending along and adjacent their respective through hole 46. At least one tritium vial 26 is inserted or embedded in each one of male and/or female clip cavities 48, 50. As previously discussed, the tritium vials 26 are often glass vials and thus susceptible to damage and/or breakage. The disposal of the tritium vial(s) 26 within the female clip cavity 48 and/or the male clip cavity 50 allows the webbing clip 40 to provide protection from such damage and/or breakage. Put another way, the webbing clip 40 nests or embeds the tritium vial(s) 26 within its female and/or male clip cavities 48, 50 to effectively isolate or reduce exposure of the tritium vials 26 to various environmental impacts encountered by the webbing clip 40.

Figure 7:
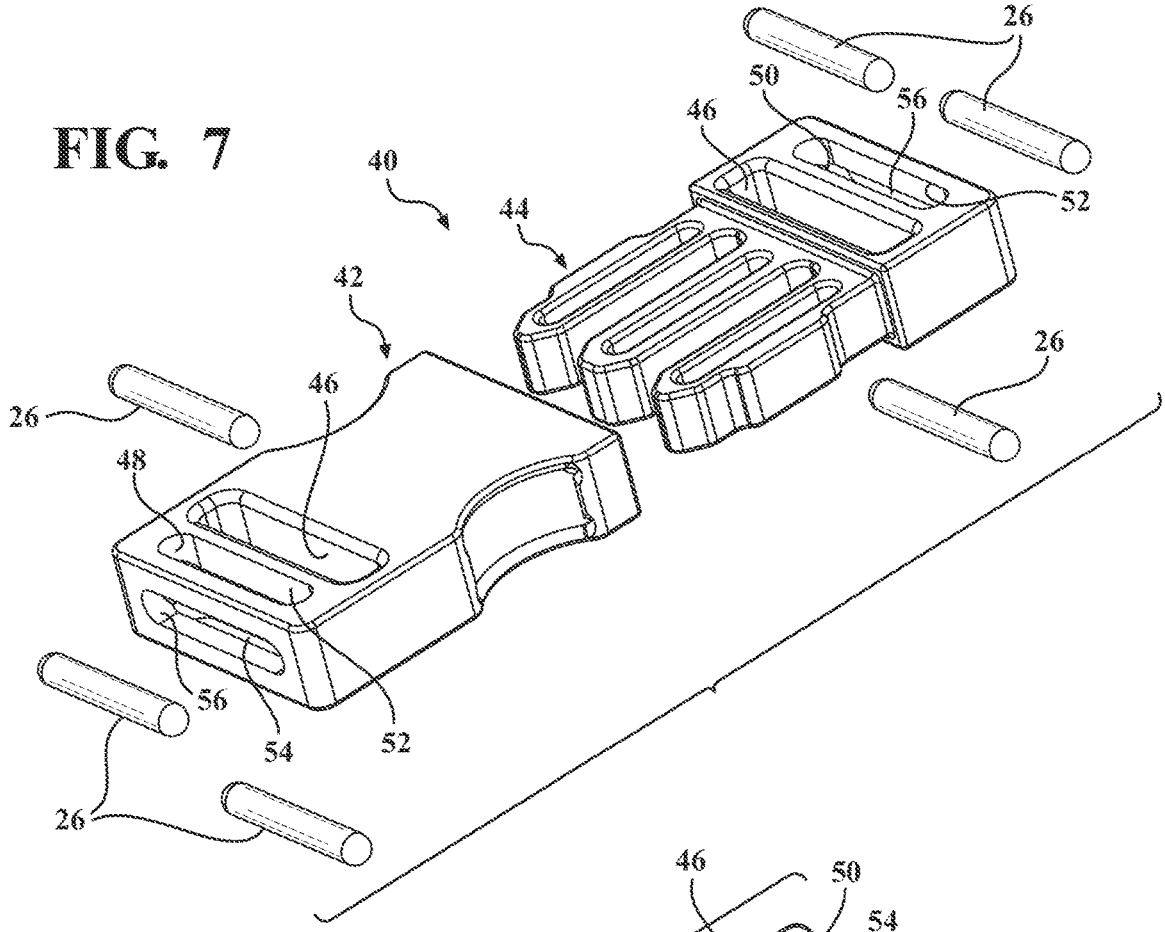
FIG. 7 is an exploded perspective view of a webbing clip incorporating tritium in accordance with a first aspect.
Figure 9:
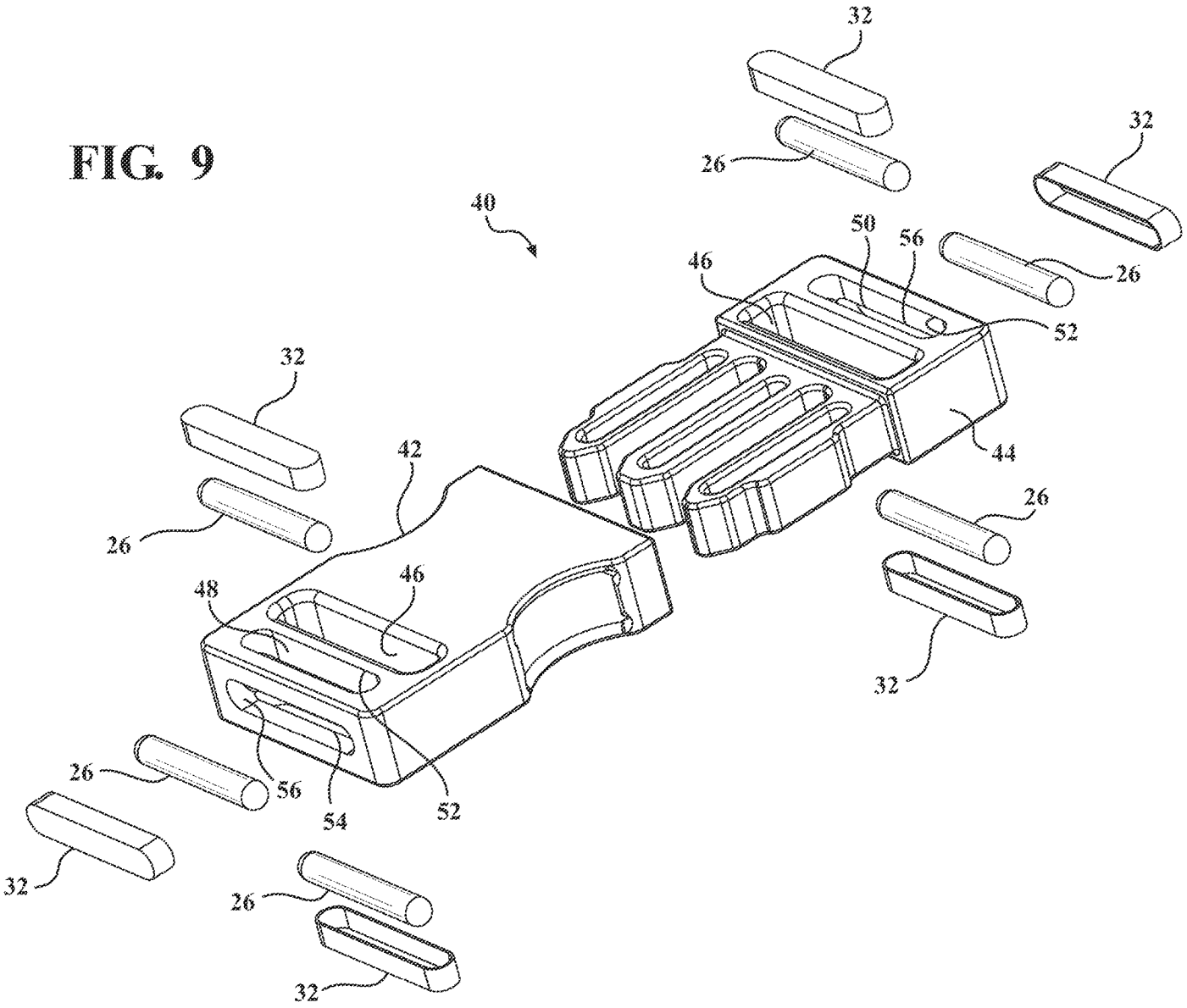
FIG. 9 is an exploded perspective view of the webbing clip incorporating tritium in accordance with a third aspect.

The female and male clip components 42, 44 can each preferably define an upper viewport 52, a lower viewport 54 and an end viewport 56 being open to their respective female and male clip cavities 48, 50 for allowing the tritium illumination provided by the tritium vial(s) 26 to be viewable by a user from multiple sides and viewing angles of the webbing clip 40. As illustrated in FIGS. 7 and 9, the at least one tritium vial 26 can include a plurality of tritium vials 26 each disposed within the female and/or male clip cavities 48, 50 adjacent a respective one of the upper, lower and end viewports 52, 54, 56 to provide additional tritium illumination for the webbing clip 40.

Figure 8:
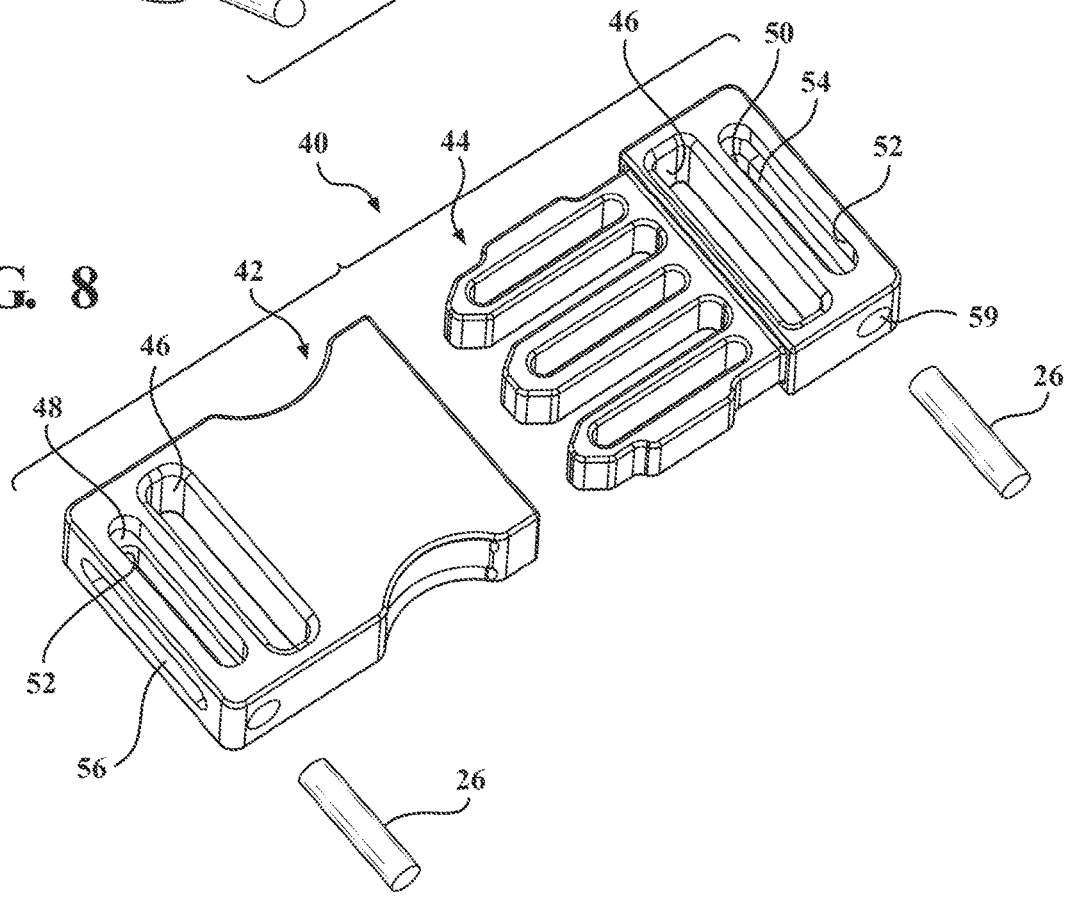
FIG. 8 is an exploded perspective view of the webbing clip incorporating tritium in accordance with a second aspect.
Figure 10:
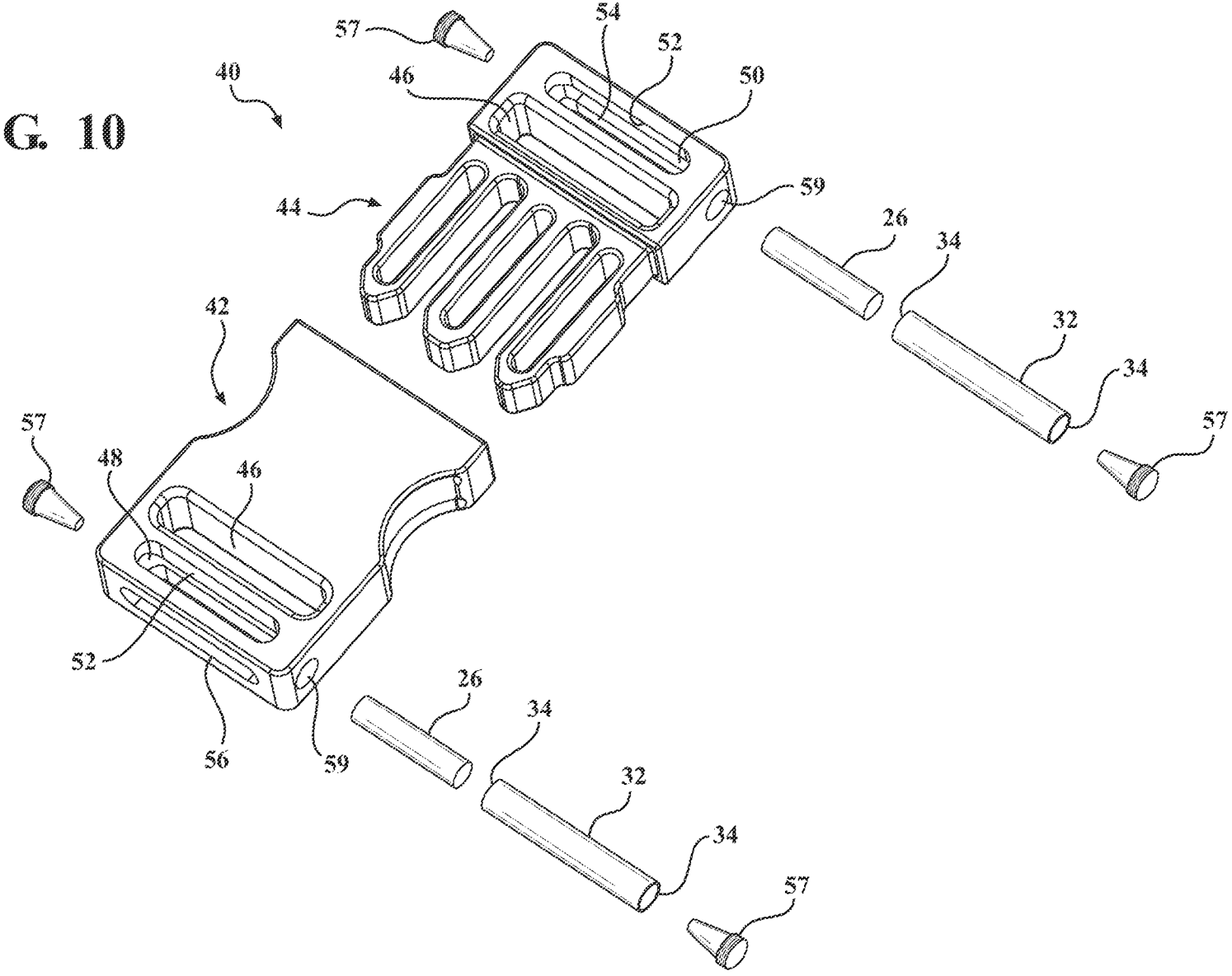
FIG. 10 is an exploded perspective view of the webbing clip incorporating tritium in accordance with a fourth aspect.
Figure 11:
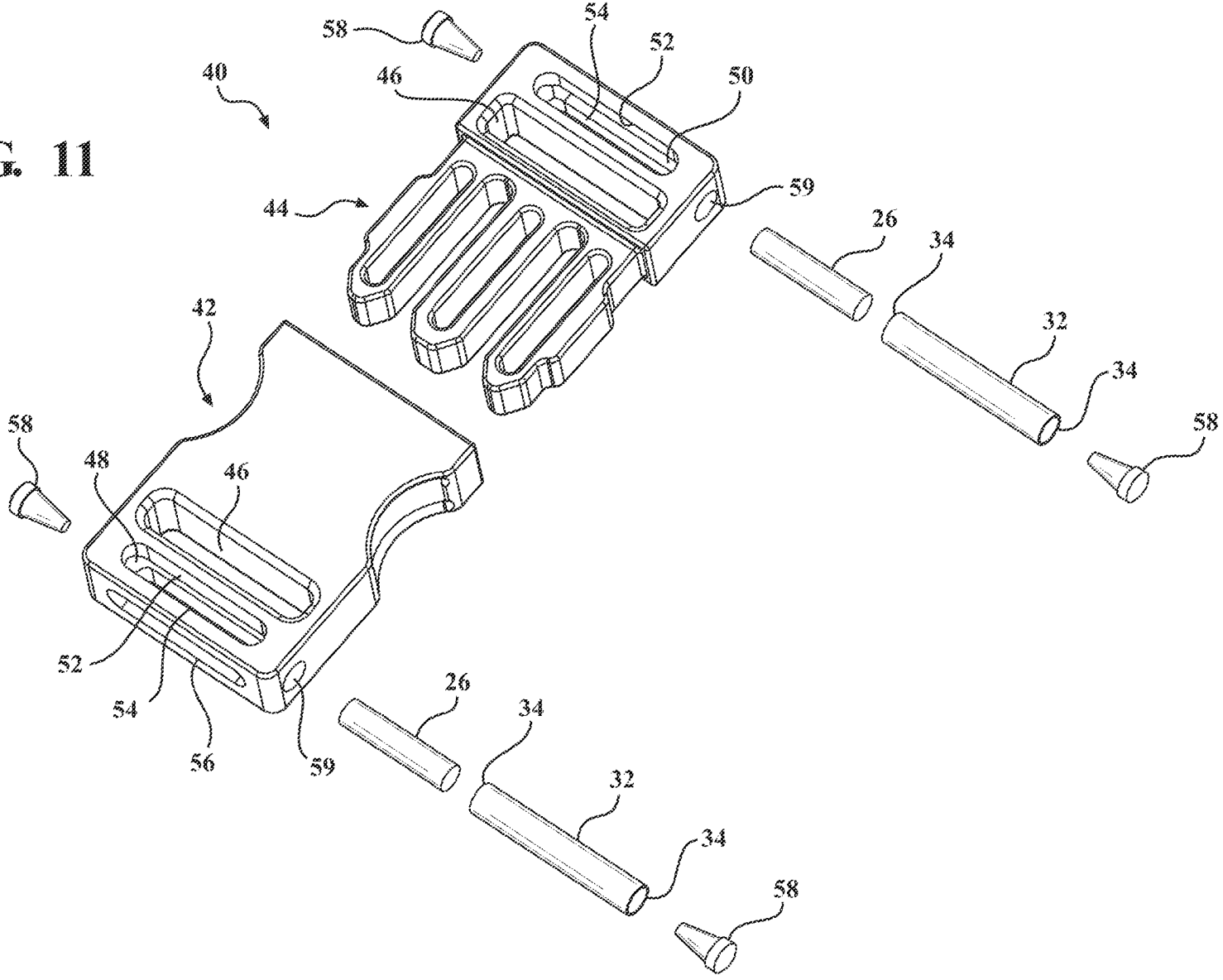
FIG. 11 is an exploded perspective view of the webbing clip incorporating tritium in accordance with a fifth aspect.

As illustrated in FIGS. 7-8, the at least one tritium vial 26 can be glued in the female clip cavity 48, and/or the male clip cavity 50. Alternatively, as illustrated in FIGS. 9-11, the at least one tritium vial 26 can be housed or secured within a protective holder 32 which is then inserted or embedded within the female clip cavity 48 and/or the male clip cavity 50 to provide additional protection for the tritium vial(s) 26. Arrangements of the protective holder 32 illustrated in FIGS. 9-11 are described in more detail in Paragraphs [0062-0065], and FIGS. 24-25 and 33-35 of Applicant's U.S. application Ser. No. 17/832,836, the disclosure of which is incorporated herein by reference. In a preferred arrangement, the protective holder 32 is comprised of transparent or translucent material, such as an injection molded plastic, for allowing illumination produced by the tritium vial 26 to be viewable by a user through the protective holder 32. However, the protective holder 32 could be comprised of other materials without departing from the scope of the subject disclosure.

As illustrated in FIGS. 10-11, when the protective holder 32 is arranged with a cylindrical shape for housing the tritium vial 26, the protective holder 32 extends between a pair of open cylindrical ends 34 that are covered with threaded caps 57 (FIG. 10) or rubbers stopper plugs 58 (FIG. 11) to trap and protect the tritium vial 26 in the center of the protective holder 32. Each of the male and female clip components 42, 44 can additionally define a side hole 59 being open to and in communication with the respective male and female clip cavities 48, 50 for allowing the protective holder 32 to be passed through the side hole 59 and into nested or embedded relationship within the male and female clip components 40, 42. As illustrated in FIG. 8, the side holes 59 could also be utilized to insert just the cylindrically shaped tritium vial 26 into the respective male and female clip cavities 48, 50. As will be appreciated by the aforementioned disclosure, in any arrangement, the incorporation of at least one tritium vial 26 into the webbing clip 40 provides aesthetic benefits to the webbing clip 40 by illuminating the male clip component 42 and/or the female clip component 44 and allowing a user to see the webbing clip 40 at all times.

FIGS. 12-18 are exploded perspective views of an alternative webbing hardware component 60 in accordance with various aspects of the subject disclosure. As best shown therein, unlike the webbing clip 40 which includes a male and female clip component 48, 50 to establish a belt-like arrangement, the webbing hardware component 60 is arranged as a single, unitary component for use with the webbing (not expressly shown). The webbing hardware component 60 defines a first passageway 62 and a second passageway 64 disposed in adjacent relationship with one another for threadingly receiving the webbing. Once mated with the webbing, similar to the webbing clip 40, the webbing hardware component 60 can also be used with backpacks, pouches, clothing (e.g., belts for hiking pants, sport pants, etc.), hanging straps when camping, and dog collars, as non-limiting examples. In each aspect, the webbing hardware component 60 houses at least one vial of tritium 26 to allow illumination produced by the tritium vial 26 to highlight the webbing hardware component 60, and allow the webbing hardware component 60 to be more easily recognized by a user, particularly when the webbing hardware component 60 is utilized in dark, night-time, or other low light conditions.

Figure 13:
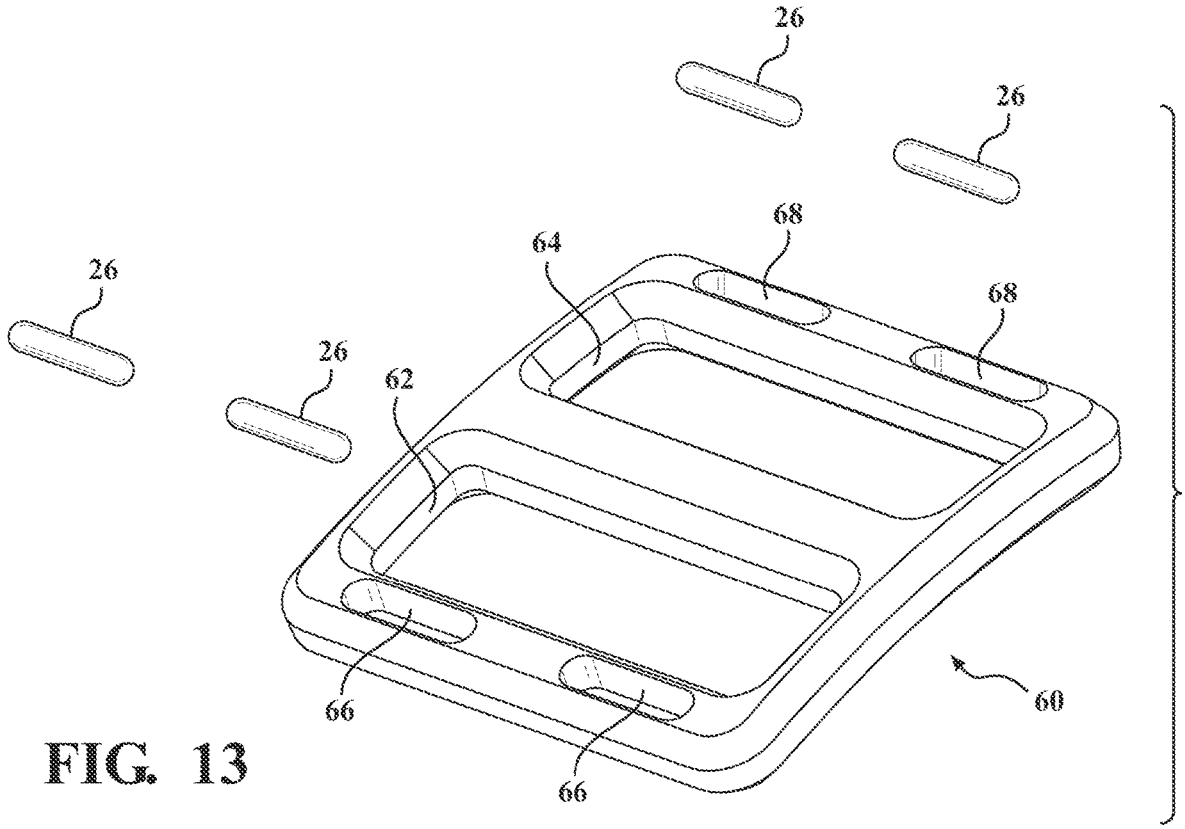
FIG. 13 is an exploded perspective view of the webbing hardware component incorporating tritium in accordance with a second aspect.
Figure 14:
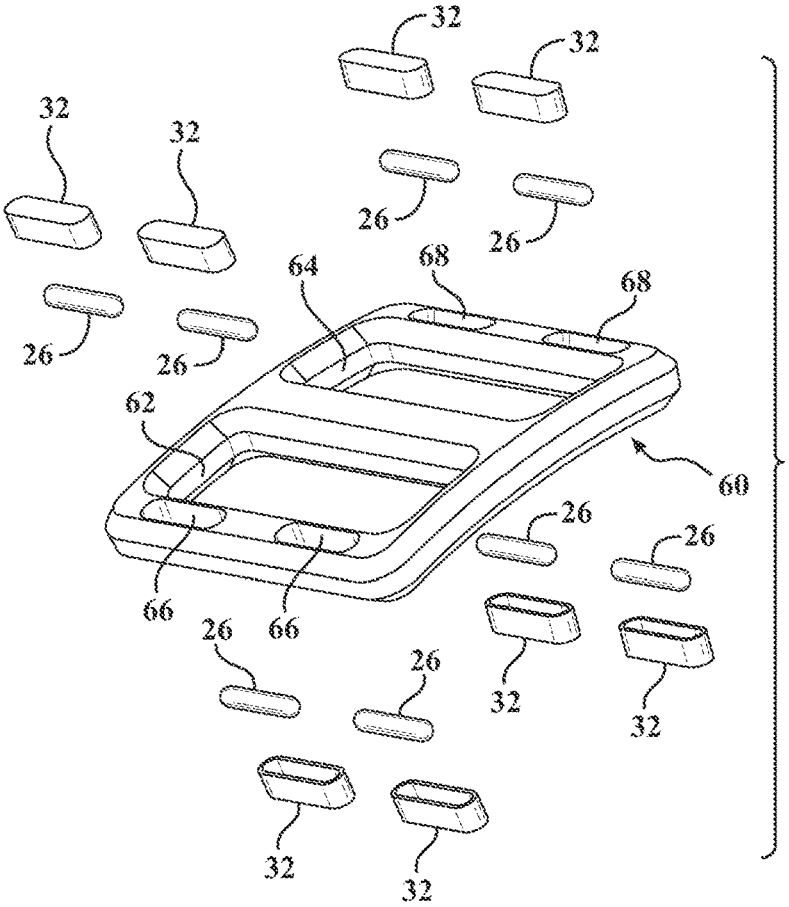
FIG. 14 is an exploded perspective view of the webbing hardware component incorporating tritium in accordance with a third aspect.
Figure 15:
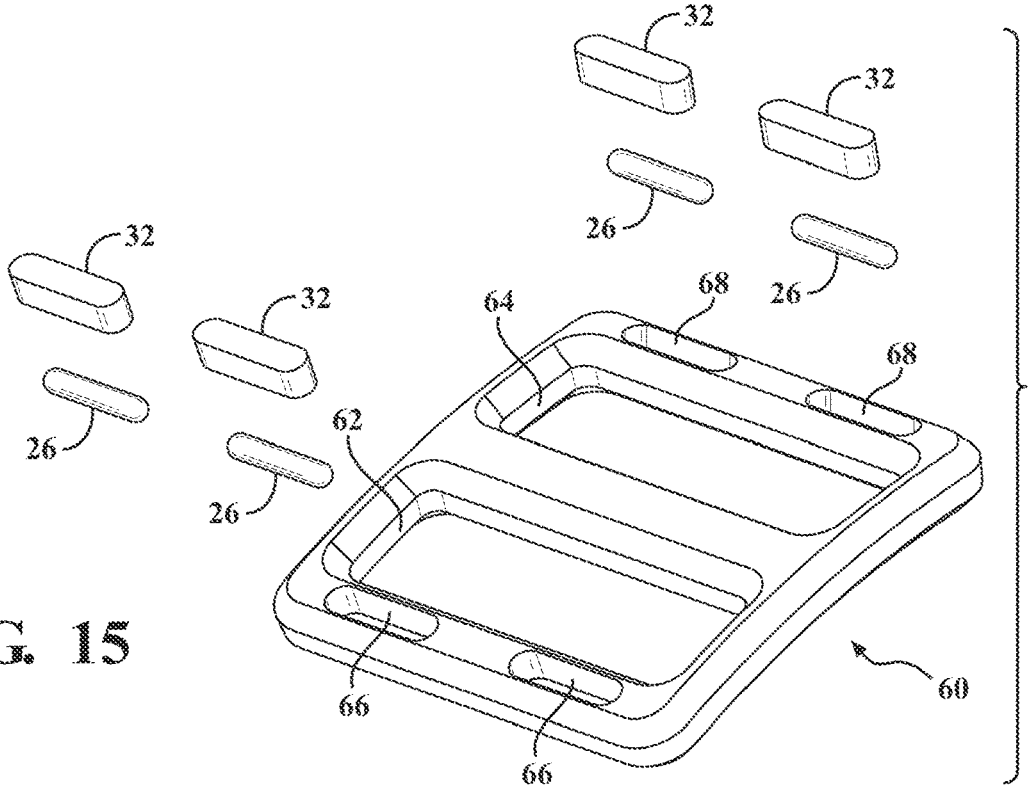
FIG. 15 is an exploded perspective view of the webbing hardware component incorporating tritium in accordance with a fourth aspect.

The webbing hardware component 60 can define at least one first hardware cavity 66 extending adjacent the first passageway 62 and at least one second hardware cavity 68 extending adjacent the second passageway 64. However, as illustrated in FIGS. 13-15, in an arrangement the webbing hardware component 60 can include a plurality of first cavities 66 extending adjacent the first passageway 62 and a plurality of second hardware cavities 68 extending adjacent the second passageway 64. Additionally, as illustrated in FIG. 14, the plurality of first and second cavities 66, 68 can extend along both an upper and lower surface of the webbing hardware component 60. In either arrangement, at least one tritium vial 26 is inserted or embedded in each one of first and second hardware cavities 66, 68. As previously discussed, the tritium vials 26 are often glass vials and thus susceptible to damage and/or breakage. The disposal of the tritium vial(s) 26 within the first and/or second hardware cavities 66, 68 allows the webbing hardware component 60 to provide protection from such damage and/or breakage. Put another way, the webbing hardware component 60 nests or embeds the tritium vial(s) 26 within its first and second hardware cavities 66, 68 to effectively isolate or reduce exposure of the tritium vials 26 to various environmental impacts encountered by the webbing hardware component 60.

As best illustrated in FIGS. 12 and 16-18, when a single first and second hardware cavity 66, 68 is utilized, the webbing hardware component 60 can preferably define an upper viewport 70, a lower viewport 72 and an end viewport 74 being open to each of the first and second hardware cavities 66, 68 for allowing the tritium illumination provided by the tritium vial(s) 26 to be viewable by a user from multiple sides and viewing angles of the webbing hardware component 60.

Figure 12:
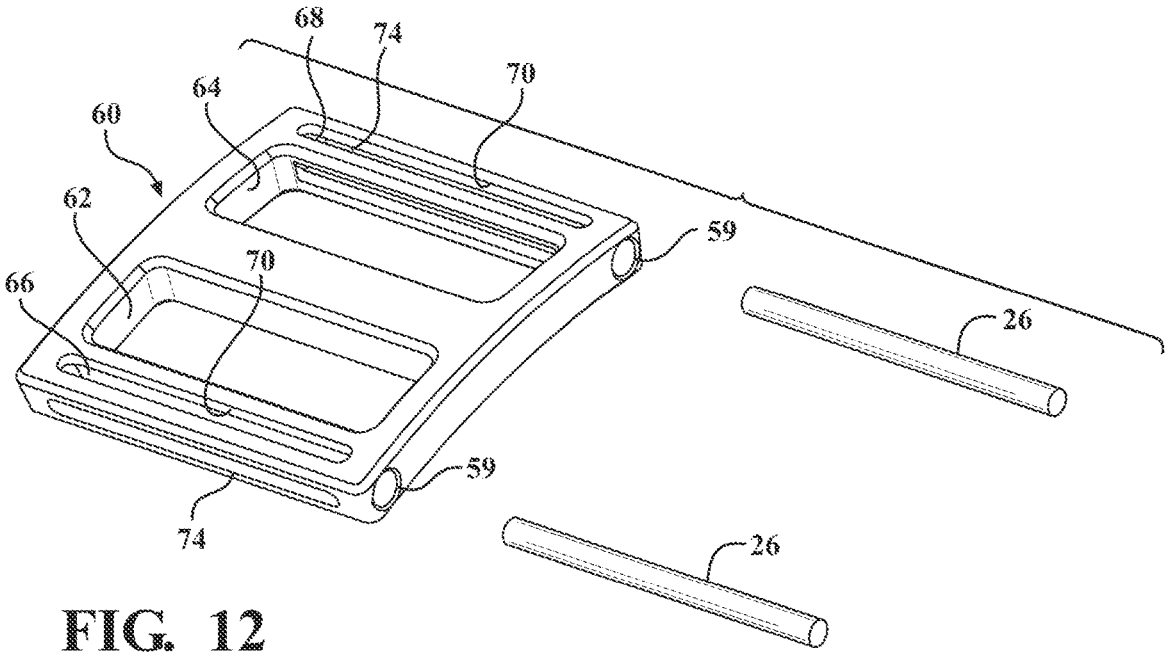
FIG. 12 is an exploded perspective view of a webbing hardware component incorporating tritium in accordance with a first aspect.

As illustrated in FIGS. 12-13, the at least one tritium vial 26 can be glued in the first and second hardware cavities 66, 68. Alternatively, as illustrated in FIGS. 14-18, the at least one tritium vial 26 can be housed or secured within a protective holder 32 which is then inserted or embedded within the first and second hardware cavities 66, 68 to provide additional protection for the tritium vial(s) 26. Arrangements of the protective holder 32 illustrated in FIGS. 15-18 are described in more detail in Paragraphs [0062-0065], and FIGS. 24-25 and 33-35 of Applicant's U.S. application Ser. No. 17/832,836, the disclosure of which is incorporated herein by reference. In a preferred arrangement, the protective holder 32 is comprised of transparent or translucent material, such as an injection molded plastic, for allowing illumination produced by the tritium vial 26 to be viewable by a user through the protective holder 32. However, the protective holder 32 could be comprised of other materials without departing from the scope of the subject disclosure.

Figure 16:
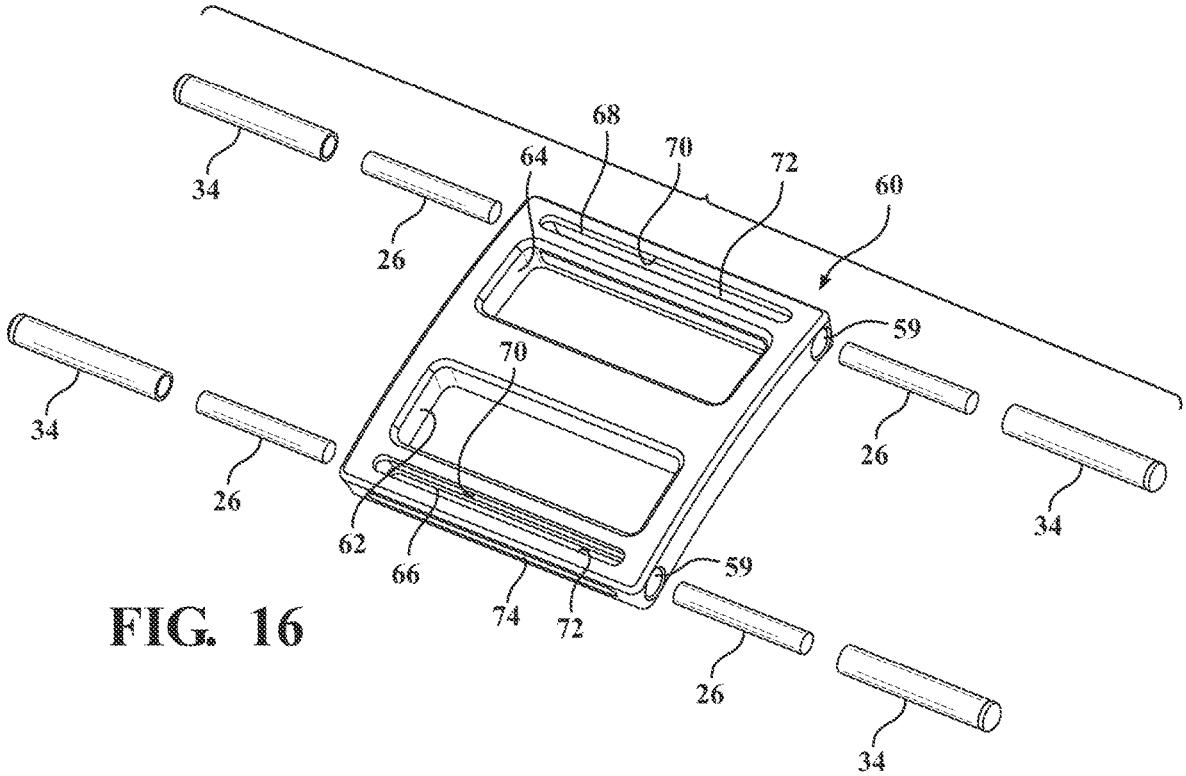
FIG. 16 is an exploded perspective view of the webbing hardware component incorporating tritium in accordance with a fifth aspect.
Figure 17:
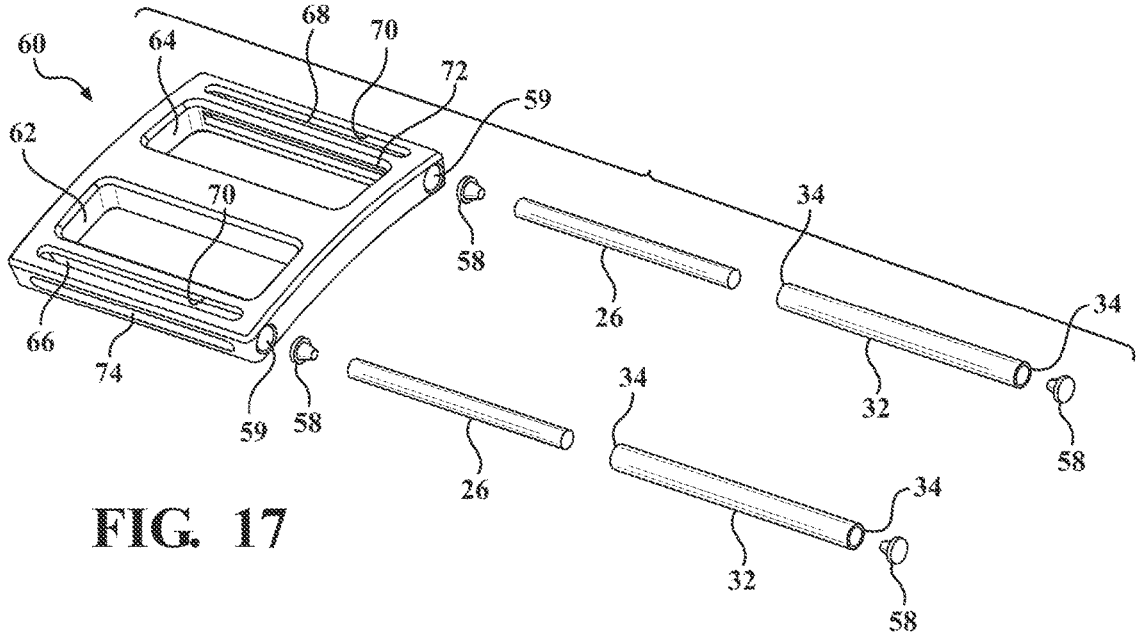
FIG. 17 is an exploded perspective view of the webbing hardware component incorporating tritium in accordance with a sixth aspect.

As illustrated in FIGS. 16-18, when the protective holder 32 is arranged with a cylindrical shape for housing the tritium vial 26, the protective holder 32 extends between a pair of open cylindrical ends 34 that are covered with threaded caps 57 (FIG. 17), rubbers stopper plugs 58 (FIG. 18) or lenses 34 (FIG. 16) to trap and protect the tritium vial 26 in the center of the protective holder 32. In this arrangement, the webbing hardware component 60 can additionally define a side hole 59 being open to and in communication with the respective first and second hardware cavities 66, 68 for allowing the protective holder 32 to be passed through the side hole 59 and into nested or embedded relationship within the webbing hardware components 60. As illustrated in FIG. 12, the side holes 59 could also be utilized to insert just the cylindrical shaped tritium vial 26 into the respective first and second hardware cavities 66, 68. As will be appreciated by the aforementioned disclosure, in any arrangement, the incorporation of at least one tritium vial 26 into the webbing hardware component 60 provides aesthetic benefits by illuminating the webbing hardware component 60 and allowing a user to see the webbing hardware component 60 at all times.

FIGS. 19-35 and 39 are perspective views of a zipper assembly 80 constructed in accordance with various aspects of the subject disclosure. As best shown therein, the zipper assembly 80 includes a slider 82 for mating with and meshing together opposing teeth 81 of a zipper 83 as the slider 82 is moved up and down to open and close the zipper 83. The zipper assembly 80 includes a pull 84 extending from a first pull end 85 that is movably attached (i.e., secured but free for pivoting and rotational movement) to the slider 82 to a second pull end 87 to present opposing and spaced apart upper and lower pull surfaces 88, 89. The pull 84 allows a user to pull on the slider 82 and effectuate the up and down movement of the slider 82 relative to the zipper 83. In each aspect of the zipper assembly 80, at least one vial of tritium 26 is housed within or secured to the pull 84 to allow illumination produced by the tritium vial 26 to highlight the pull 84 and allow a location of the slide 82 and pull 84 to be more easily recognized by a user of the zipper assembly 80, particularly when the zipper assembly 80 is utilized in dark, night-time, or other low light conditions.

As illustrated in FIGS. 19-23 and 39, in accordance with a first embodiment of the zipper assembly 80, the pull 84 can define at least one pull cavity 86 and at least one tritium vial 26 is inserted or embedded in the at least one pull cavity 86. As previously discussed, the tritium vials 26 are often glass vials and thus susceptible to damage and/or breakage. The disposal of the tritium vial(s) 26 within the pull cavity 86 allows the pull 84 to provide protection from such damage and/or breakage. Put another way, the pull 84 nests or embeds the tritium vial(s) 26 within its pull cavities 86 to effectively isolate or reduce exposure of the tritium vials 26 to various environmental impacts encountered by the zipper assembly 80.

Figure 20:
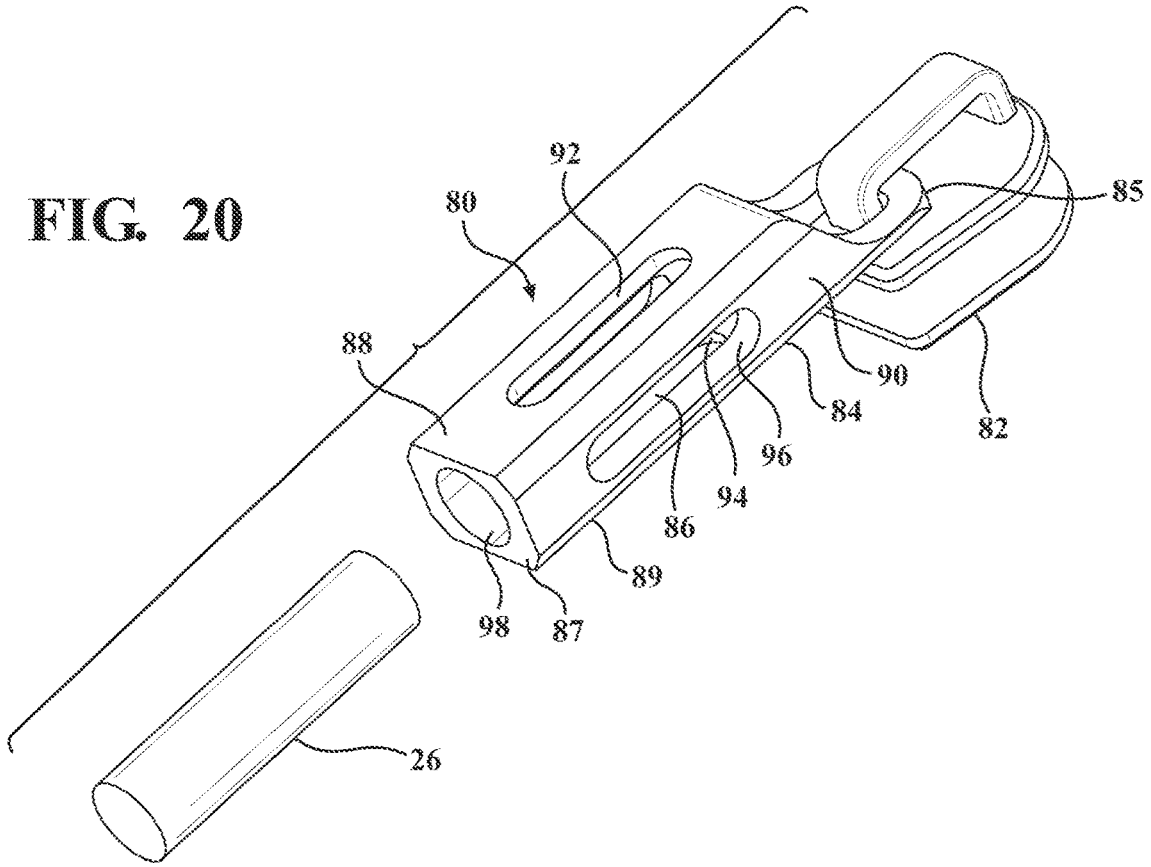
FIG. 20 is an exploded perspective view of the zipper assembly incorporating tritium in accordance with a second aspect.
Figure 21:
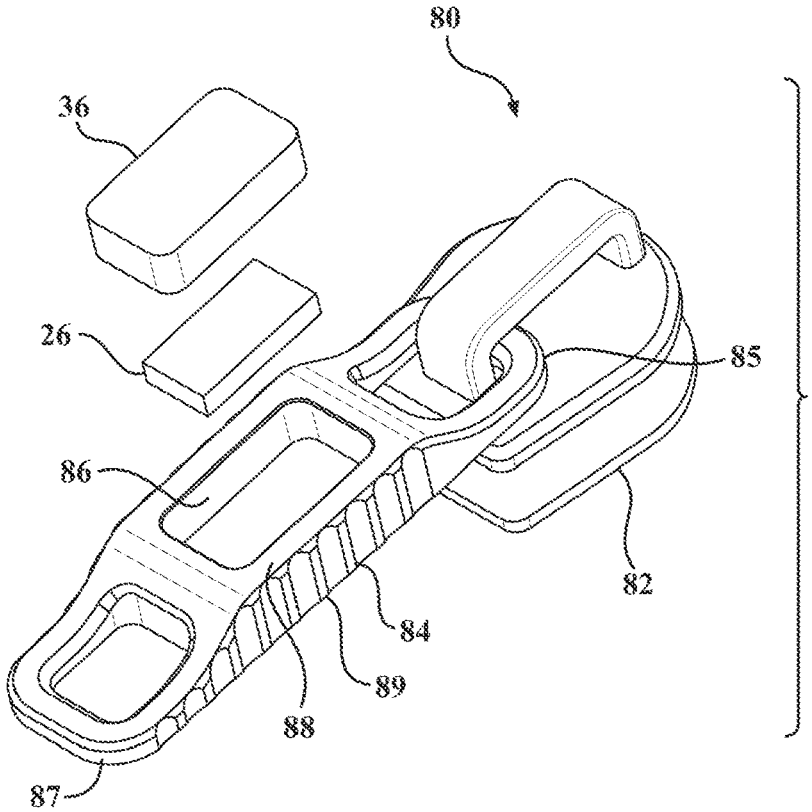
FIG. 21 is an exploded perspective view of the zipper assembly incorporating tritium in accordance with a third aspect.
Figure 22:
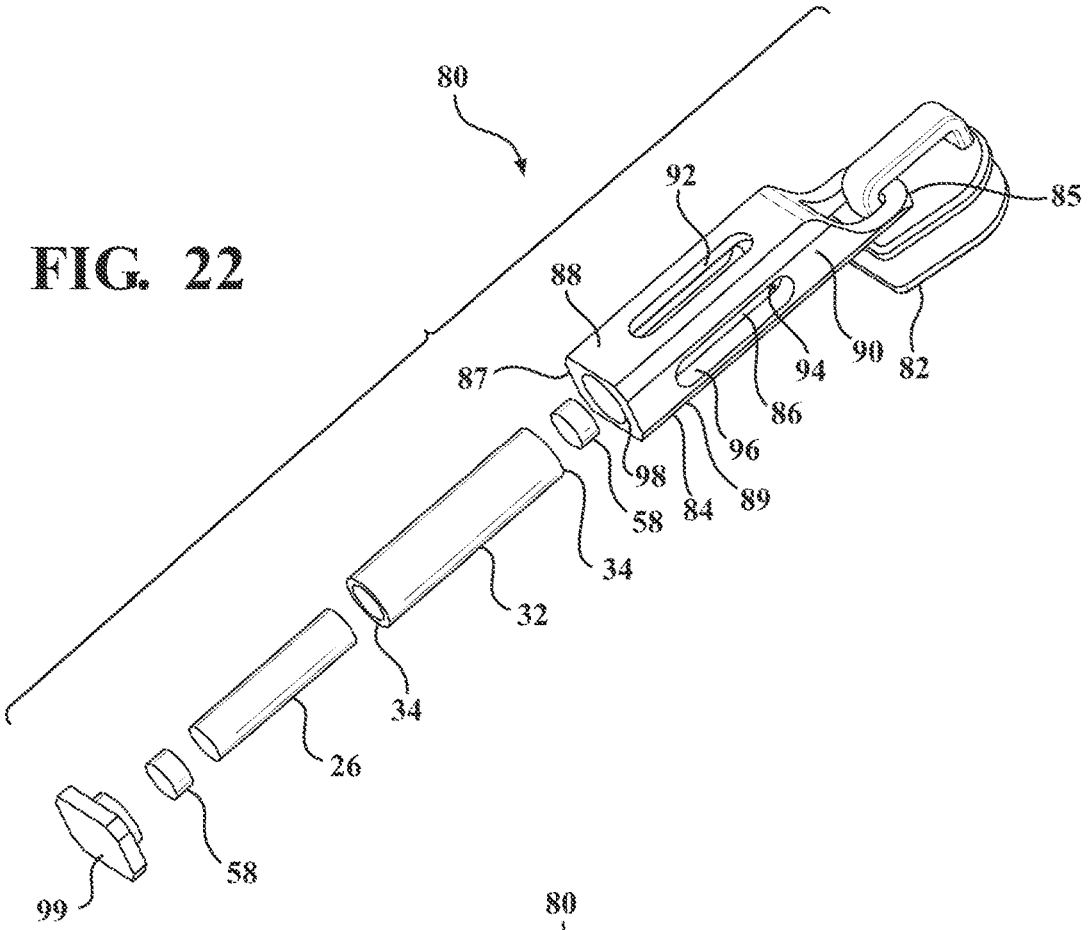
FIG. 22 is an exploded perspective view of the zipper assembly incorporating tritium in accordance with a fourth aspect.
Figure 39:
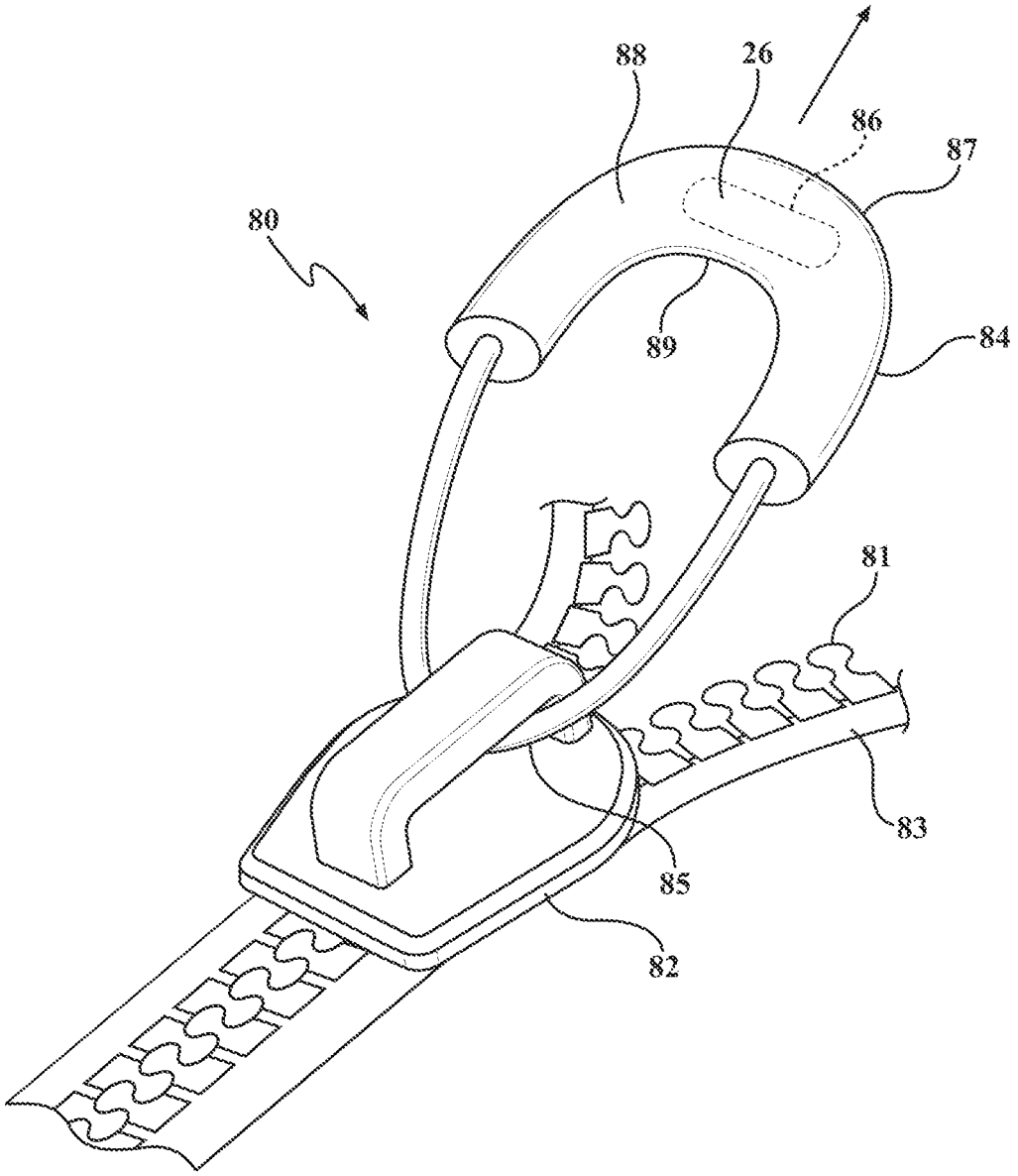
FIG. 39 is a perspective view of the zipper assembly incorporating tritium in accordance with a sixth aspect.

As illustrated in FIGS. 19, 21, 23 and 36, the pull cavity 86 can extend downwardly from the upper pull surface 88 of the pull 84. Alternatively, or in addition to, the pull cavity 86 can also extend inwardly from one of (or both of) the side walls 90 extending between the upper and lower pull surfaces 88, 89 of the pull 84. (See FIGS. 19 and 23). However, as illustrated in FIGS. 20 and 22, the pull cavity 86 can extend between and in generally parallel relationship to the upper and lower pull surfaces 88, 89 and through a central portion of the pull 84 from adjacent the first pull end 85 to adjacent the second pull end 87. Alternatively, as illustrated in FIG. 39, the pull cavity 86 can be embedded within a portion of the pull 84 between the upper and lower pull surfaces 88, 89, such as a portion to be engaged by the user. As further illustrated in FIGS. 20 and 22, when the centrally located pull cavity 86 is utilized, the pull 84 can preferably include an upper viewport 92 defined by the upper pull surface 88, a lower viewport 94 defined by the lower pull surface 89, and/or at least one side viewports 96 defined by the side wall(s) 90, with each of the viewports 92, 94, 96 being open to the pull cavity 86 for allowing the tritium illumination provided by the tritium vial(s) 26 to be viewable by a user from multiple sides and viewing angles of the pull 84. However, as illustrated in FIG. 39, the portion of the pull 84 defining the pull cavity 86 can also be comprised of transparent or translucent material for allowing the tritium 26 to be viewed there through.

Figure 23:
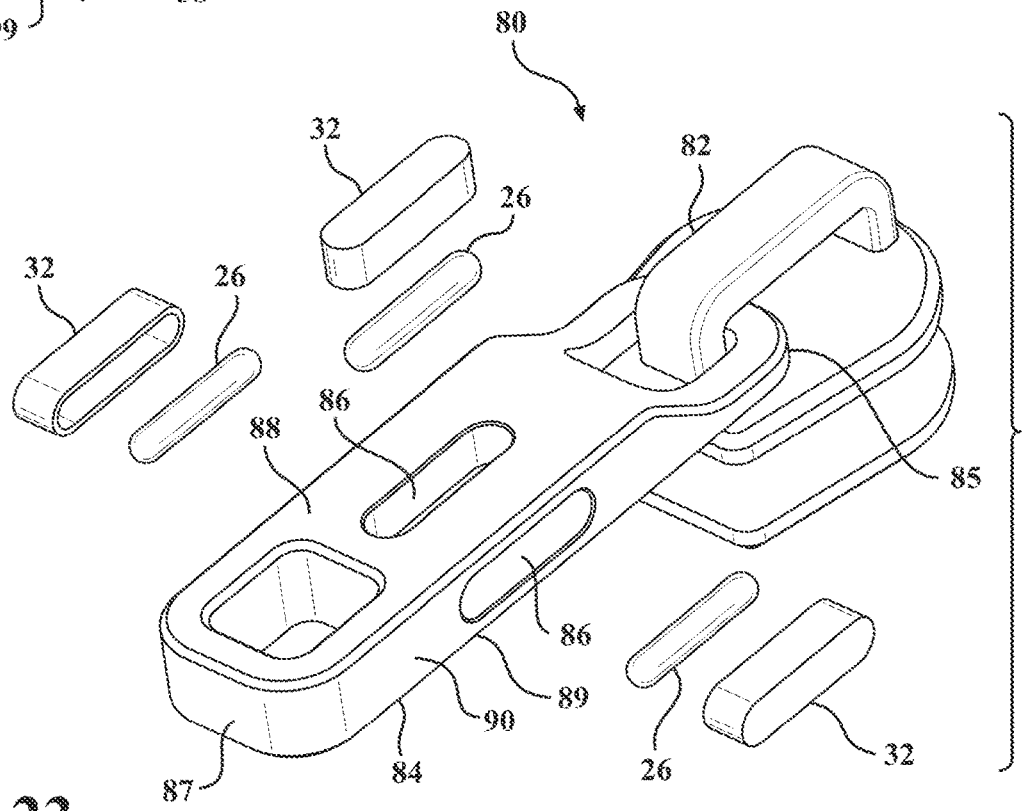
FIG. 23 is an exploded perspective view of the zipper assembly incorporating tritium in accordance with a fifth aspect.
Figure 24A:
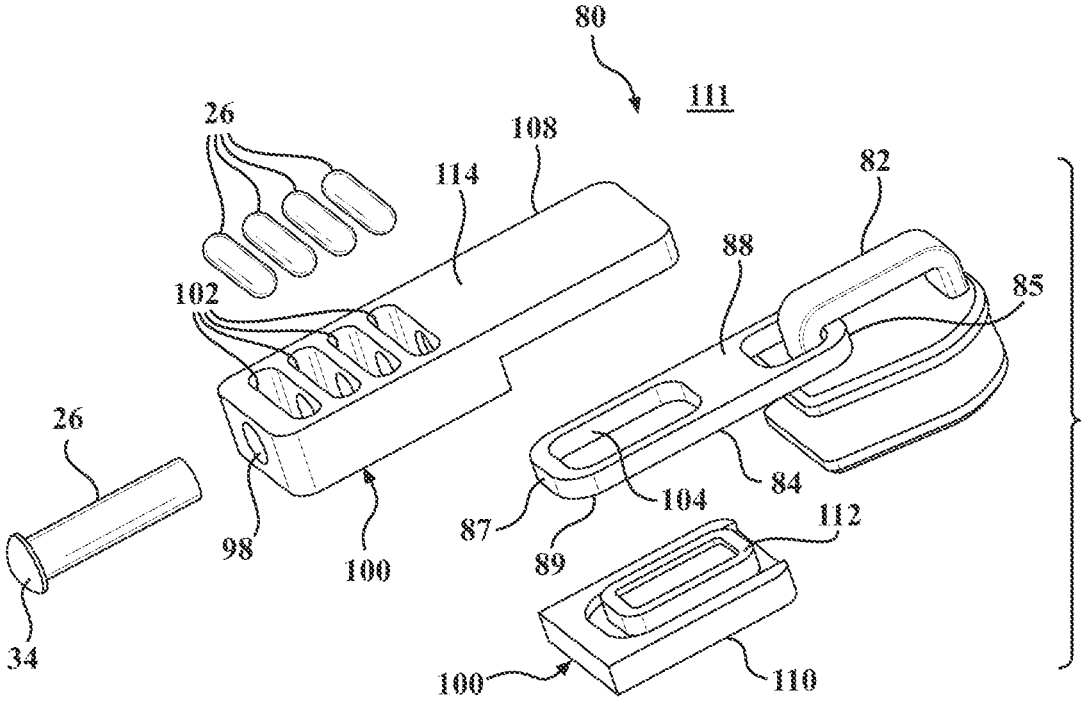
FIGS. 24A-B are exploded perspective views of the zipper assembly including a carrier assembly constructed in accordance with a first aspect for incorporating tritium.
Figure 24B:
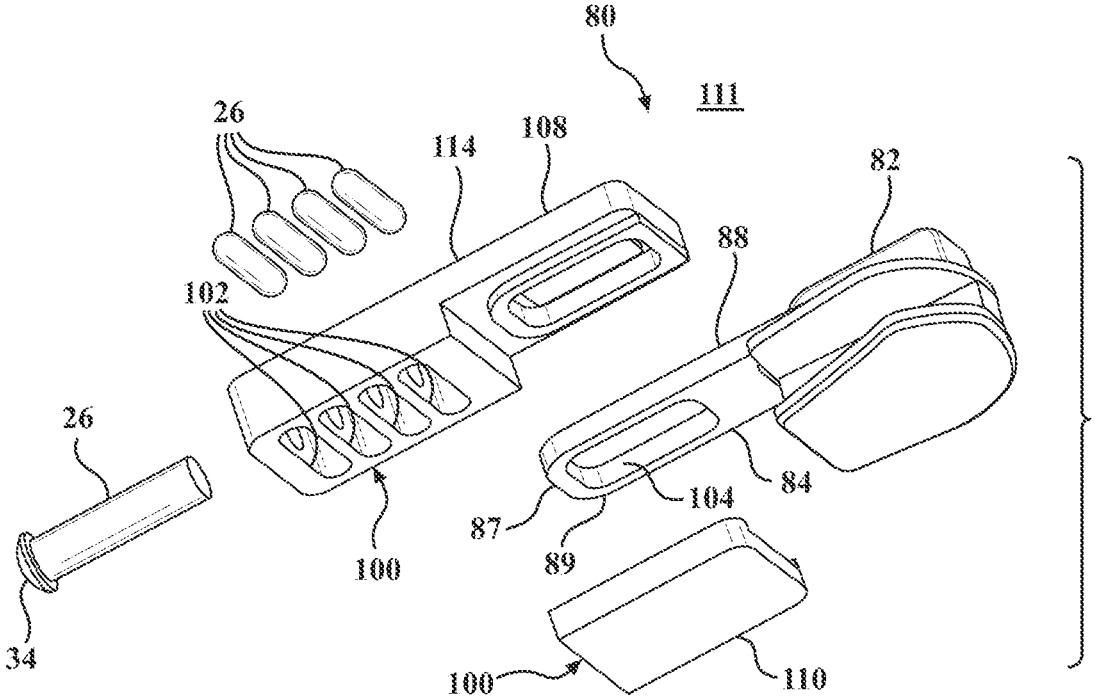
Figure 25:
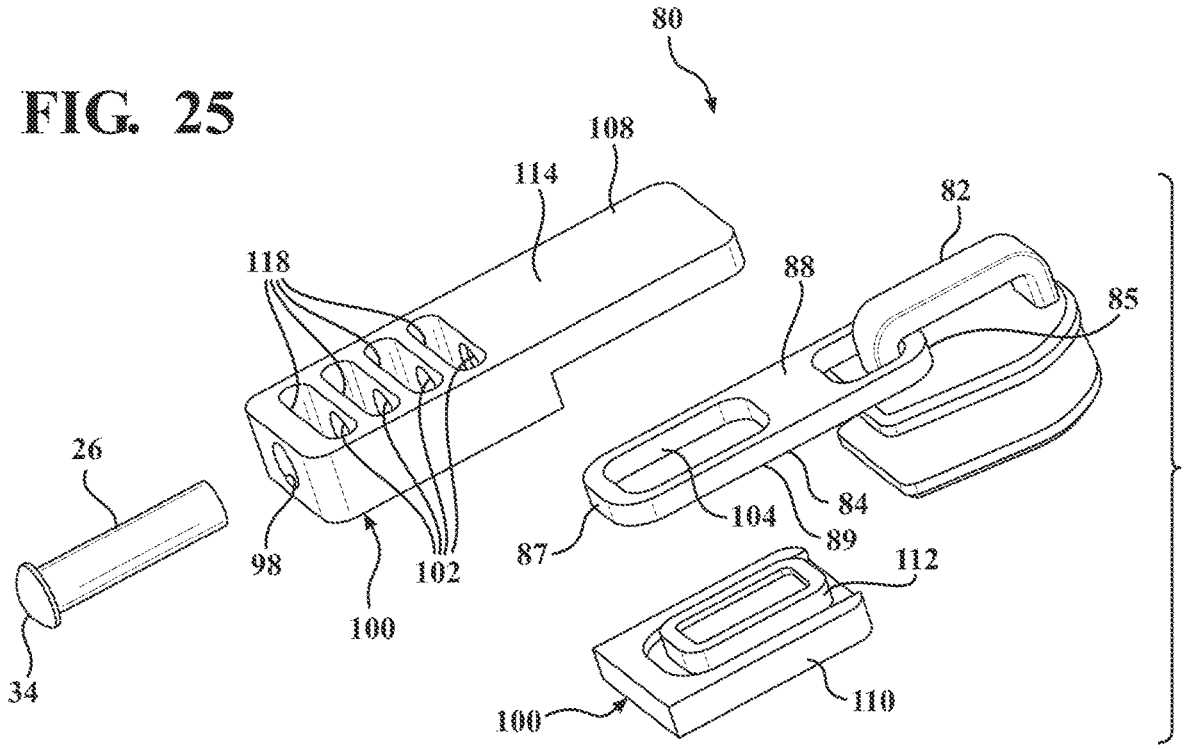
FIG. 25 is an exploded perspective view of the zipper assembly including the carrier assembly constructed in accordance with a second aspect for incorporating tritium.
Figure 26:
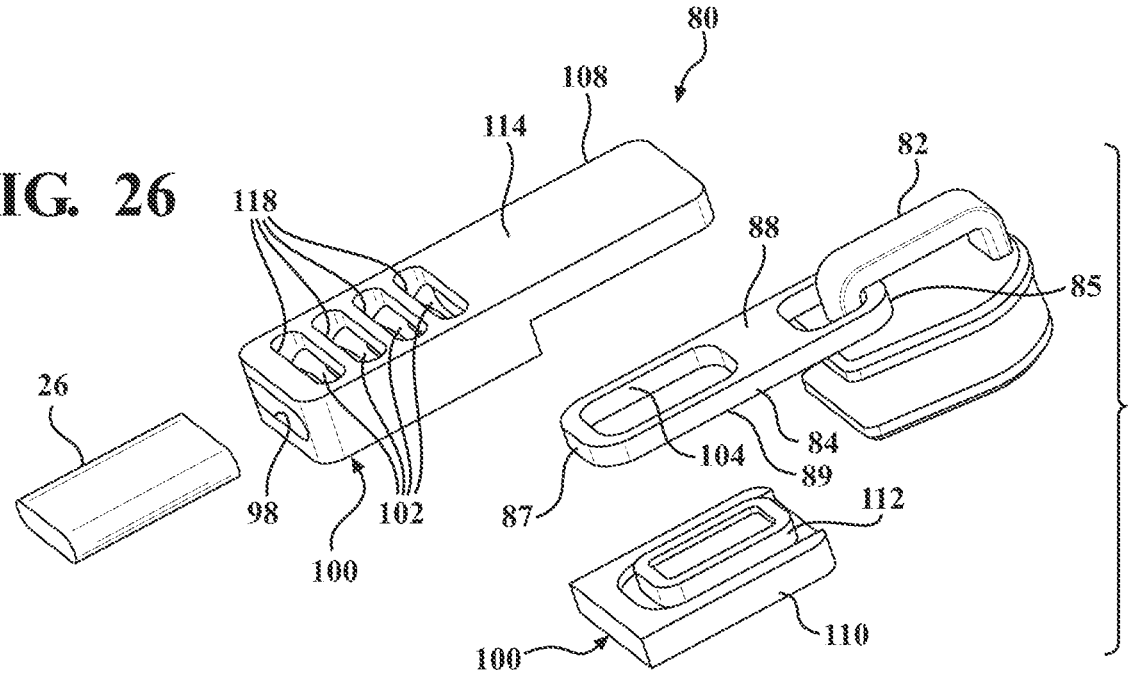
FIG. 26 is an exploded perspective view of the zipper assembly including the carrier assembly constructed in accordance with a third aspect for incorporating tritium.

As illustrated in FIGS. 19-20, the at least one tritium vial 26 can be glued in the pull cavity 84. Alternatively, as illustrated in FIGS. 21-23, the at least one tritium vial 26 can be housed or secured within a protective holder 32 which is then inserted or embedded within the pull cavity 84 to provide additional protection for the tritium vial(s) 26. Put another way, in accordance with an aspect, the protective holder 32 can be disposed within the pull cavity 84 to cover and protect the at least one tritium vial 26 from an environment of the zipper assembly 80. Arrangements of the protective holder 32 illustrated in FIGS. 21-23 are described in more detail in Paragraphs [0062-0065], and FIGS. 24-25, 28-29 and 33-35 of Applicant's U.S. application Ser. No. 17/832,836, the disclosure of which is incorporated herein by reference. In a preferred arrangement, the protective holder 32 is comprised of transparent or translucent material, such as an injection molded plastic, for allowing illumination produced by the tritium vial 26 to be viewable by a user through the protective holder 32. However, the protective holder 32 could be comprised of other materials without departing from the scope of the subject disclosure.

As illustrated in FIGS. 20 and 22, when the protective holder 32 is arranged with a cylindrical shape for housing the tritium vial 26, the protective holder 32 can extend between a pair of open cylindrical ends 34 that are covered with rubber stopper plugs 58 (FIG. 22, as an example) to trap and protect the tritium vial 26 in the center of the protective holder 32. In this arrangement, the second pull end 87 of the pull 84 can additionally define an end orifice 98 being open to and in communication with the pull cavity 86 arranged in the central portion of the pull 84 for allowing the protective holder 32 to be passed through the end orifice 98 and into nested or embedded relationship within the pull 84. As illustrated in FIG. 20, the end orifice 98 could also be utilized to insert just the cylindrically shaped tritium vial 26 into the pull cavity 86. In either arrangement, a cap 99 can be placed over the end orifice 98 to hold the cylindrically shaped protective housing 32 or tritium vial 26 within the pull cavity 86. (See FIG. 22).

As illustrated in FIGS. 24A-38, in accordance with a second embodiment of the zipper assembly 80, a clip-on carrier assembly 100 defining at least one carrier cavity 102 is directly or indirectly secured to the pull 84 and at least one tritium vial 26 is inserted or embedded in the carrier cavity 102. As previously discussed, the tritium vials 26 are often glass vials and thus susceptible to damage and/or breakage. The disposal of the tritium vial(s) 26 within the carrier cavity 102 allows tritium to be attached to the pull 84 while also providing protection from such damage and/or breakage by way of the clip-on carrier 102. Put another way, the clip-on carrier 100 is arranged as a separate component to nest or embed the tritium vial(s) 26 within its carrier cavity 102, and then is attached to the pull 84 to incorporate tritium into the zipper assembly 80. Use of the clip-on carrier 100 also advantageously allows tritium illumination to be added to zipper assemblies 80 as an after-market component.

The pull 84 defines a pull opening 104 extending between the upper and lower pull surfaces 88, 89 and, as illustrated in FIGS. 24-28 and 36-38, in accordance with a first aspect the clip-on carrier assembly 100 is releasably mated with the pull opening 104 to attach the clip-on carrier 100 directly to the pull 84 and incorporate the tritium 26 into the zipper assembly 80. However, as illustrated in FIGS. 29-35, in accordance with a second aspect, a zipper cord 106 is wrapped around and through the pull opening 104 and the clip-on carrier 100 is releasably mated with the zipper cord 106 to indirectly attach the clip-on carrier assembly 100 to the pull 84 and incorporate the tritium 26 into the zipper assembly 80. Each of these aspects provide different ways of attaching the clip-on carrier assembly 100 to the zipper assembly 80, depending on its arrangement in the original product (e.g., sweatshirts, bags, back-packs, luggage or the like, as non-limiting examples).

Figure 36:
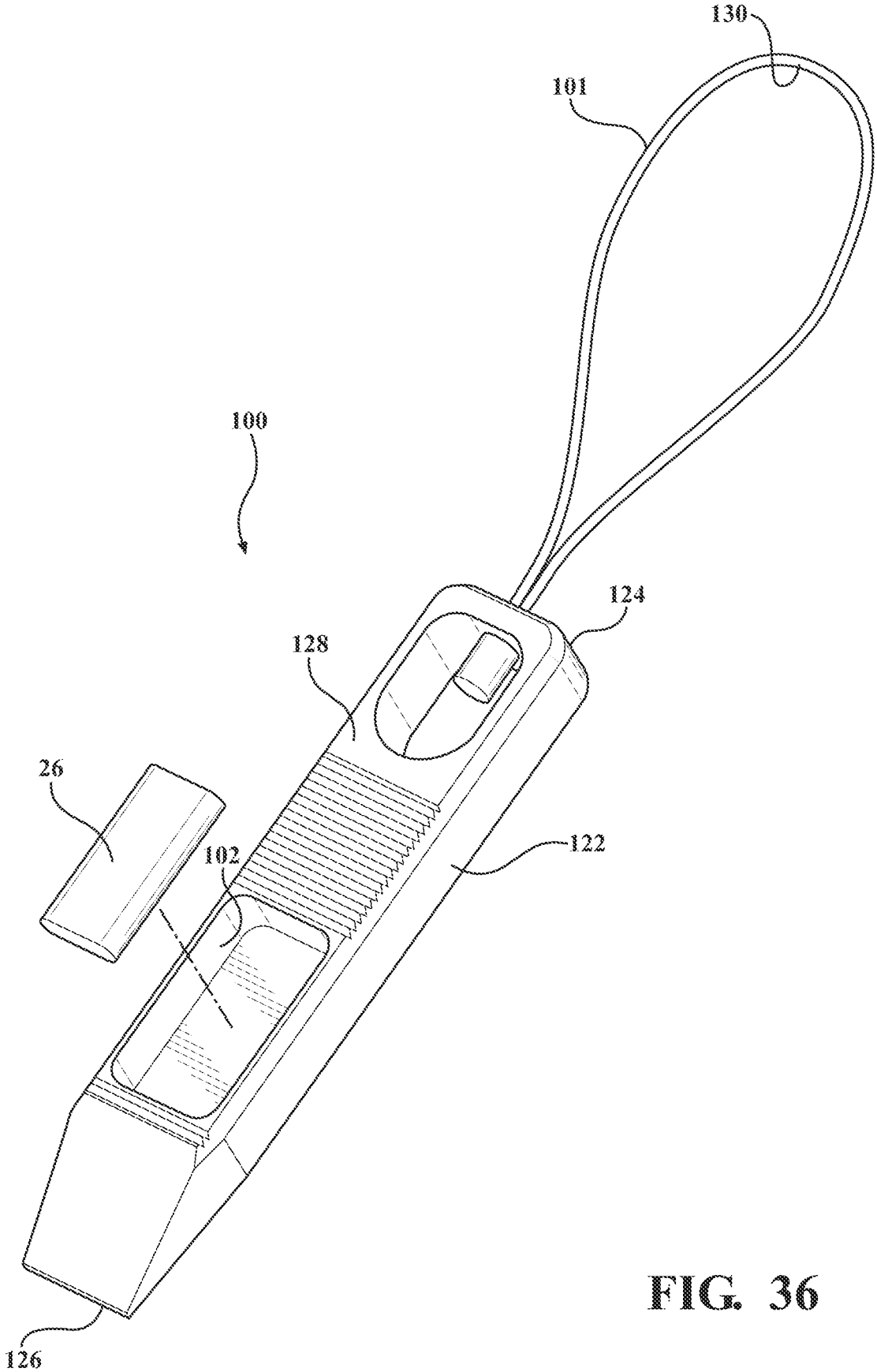
FIG. 36 is a perspective view of the carrier assembly constructed in accordance with a thirteenth aspect for incorporating tritium.
Figure 37:
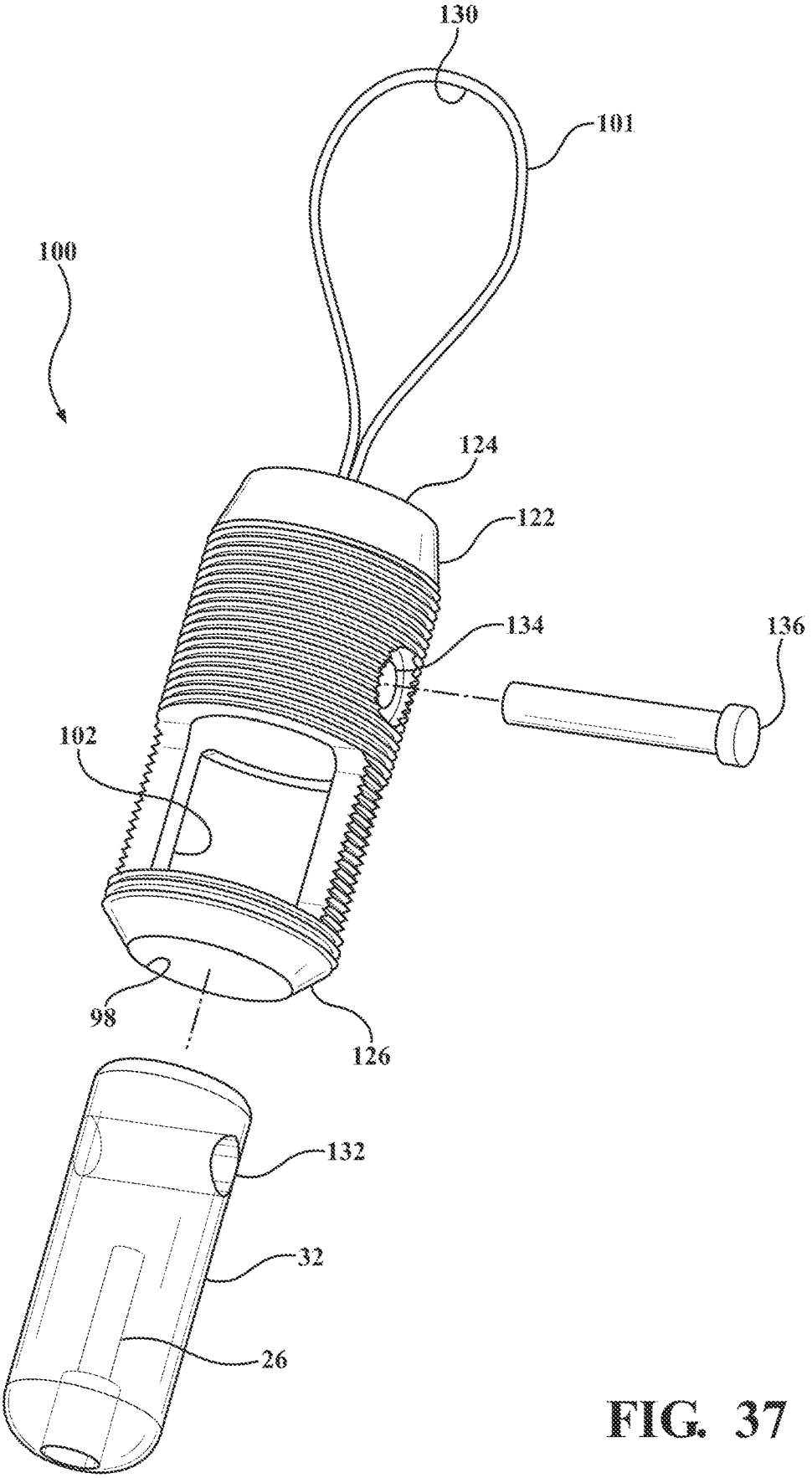
FIG. 37 is an exploded perspective view of the carrier assembly constructed in accordance with a fourteenth aspect for incorporating tritium.
Figure 38:
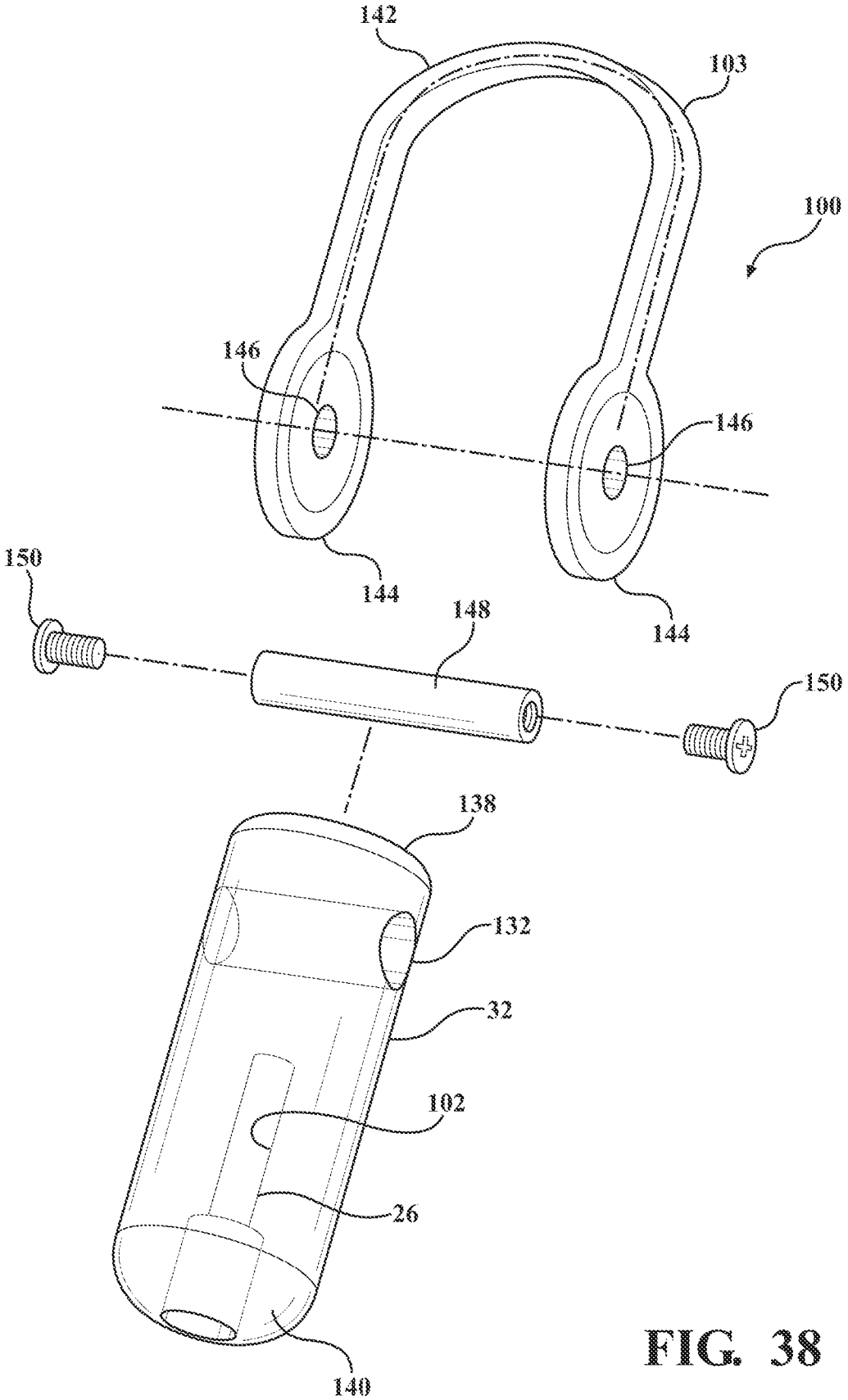
FIG. 38 is an exploded perspective view of the carrier assembly constructed in accordance with a fifteenth aspect for incorporating tritium.

As illustrated in FIGS. 24A-35, in accordance with an embodiment, the clip-on carrier assembly 100 includes an upper clip component 108 and a lower clip component 110 which are releasably clipped to one another to secure the clip-on carrier assembly 100 to the pull 84. However, as illustrated in FIGS. 36-38, in accordance with another embodiment, the clip-on assembly 100 can alternatively include a carrier cord 101 (See FIGS. 36-37) or a shackle 103 (See FIG. 38) for releasably securing the clip-on carrier assembly 100 to the pull 84.

As illustrated in FIGS. 24A-28, in accordance with the first aspect, the lower clip component 100 can define a male protrusion 112 which passes through the pull opening 104 and mates with a female depression 111 correspondingly defined by the upper clip component 110 to secure the clip-on carrier 100 to the pull 84. The arrangement of the male protrusion 112 and the female depression 111 could be reversed, without departing from the scope of the disclosure. However, as illustrated in FIGS. 29-35, the upper and lower clip components 108, 110 could alternatively define corresponding semi-circular recesses 113 which wrap around the zipper cord 106 when the upper and lower clip components 108, 110 are clipped together to secure the clip-on carrier 100 to the pull 84.

Figure 31:
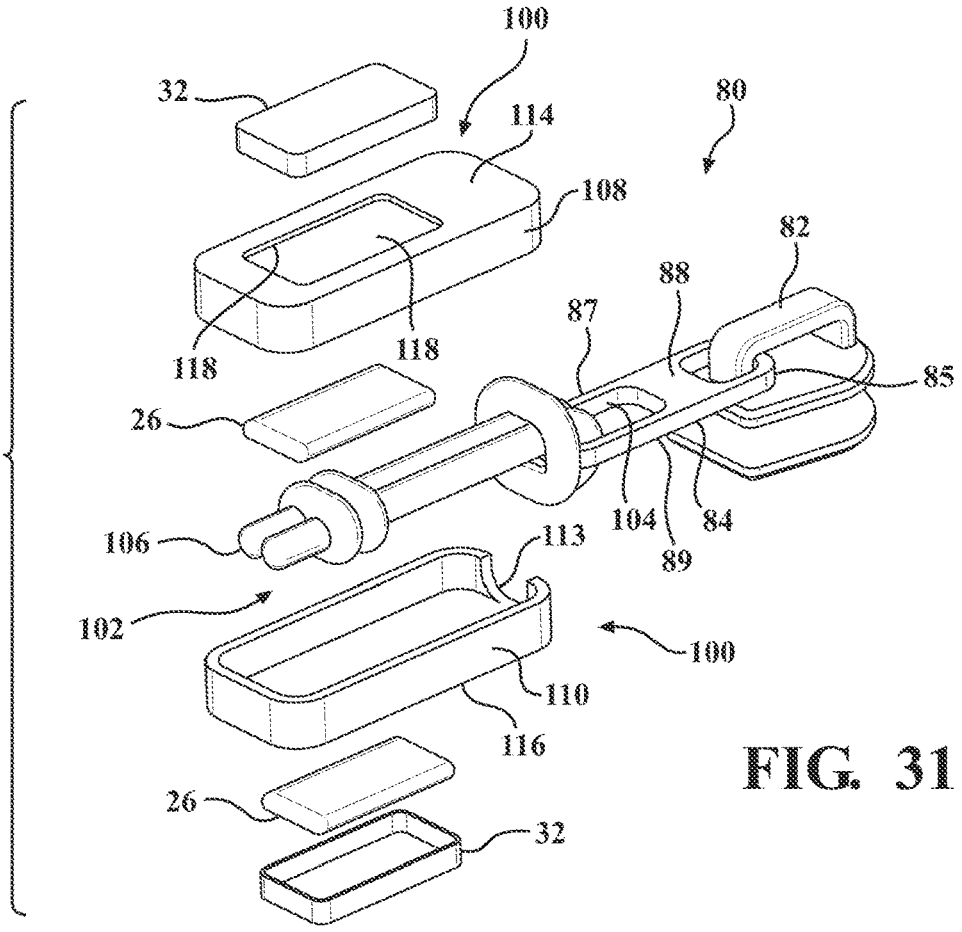
FIG. 31 is an exploded perspective view of the zipper assembly including the carrier assembly constructed in accordance with an eighth aspect for incorporating tritium.

In either arrangement, at least one carrier cavity 102 can be defined by the upper clip component 108, the lower clip component 100 or by an area disposed between these two clipped together components 108, 110. More specifically, as illustrated in FIGS. 24A-27, 30-31 and 34, the at least one carrier cavity 102 can be defined by the upper clip component 108 and extend downwardly from an upper clip surface 114 or inwardly from a side clip surface 115. In this arrangement, and as illustrated in FIGS. 24-27, the upper clip component 108 can define a plurality of carrier cavities 102. Further, as illustrated in FIG. 31, the at least one carrier cavity 102 can be defined by the lower clip component 100 and extend upwardly from a lower clip surface 116. Additionally, as illustrated in FIGS. 28-29 and 32-35, the at least one carrier cavity 102 can be defined as an area disposed between the two clipped together upper and lower components 108, 110.

Figure 27:
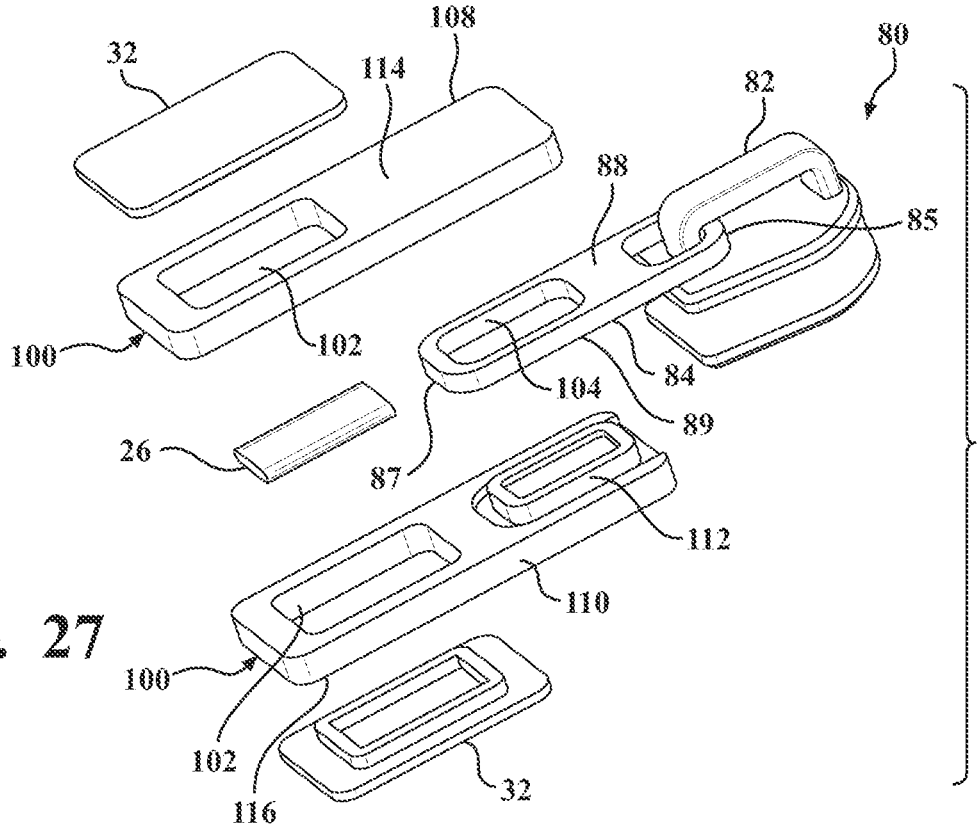
FIG. 27 is an exploded perspective view of the zipper assembly including the carrier assembly constructed in accordance with a fourth aspect for incorporating tritium.
Figure 28A:
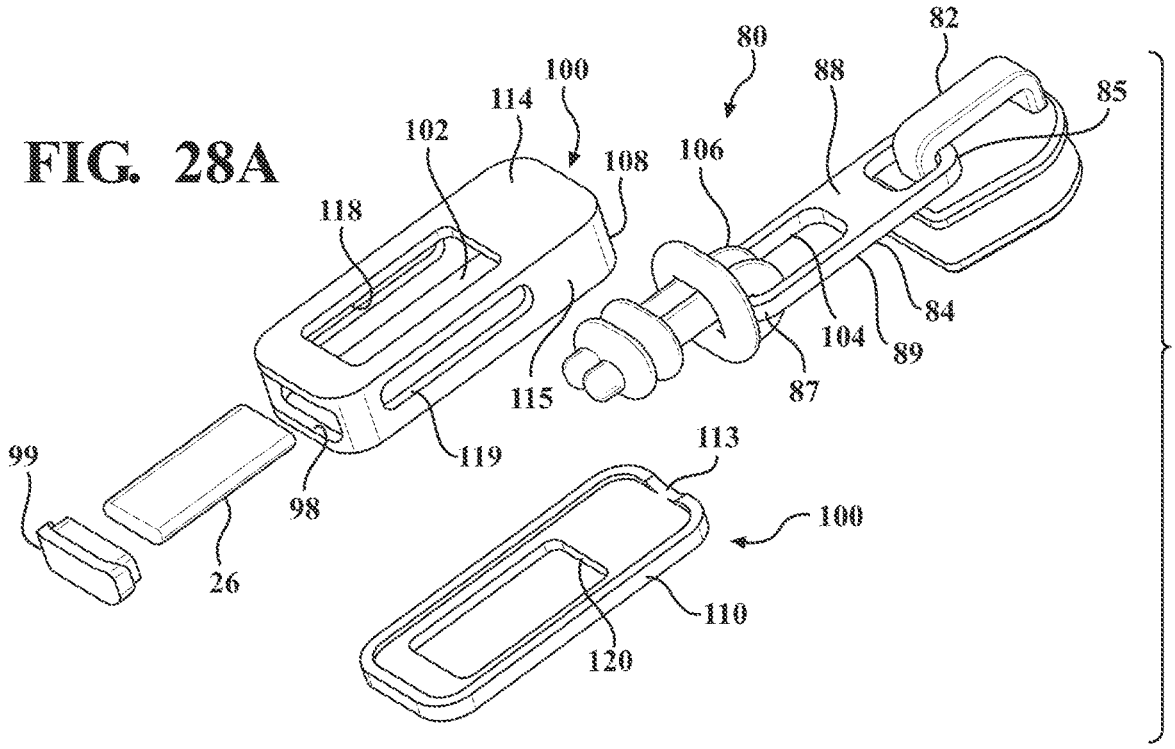
FIGS. 28A-B are exploded perspective views of the zipper assembly including the carrier assembly constructed in accordance with a fifth aspect for incorporating tritium.
Figure 28B:
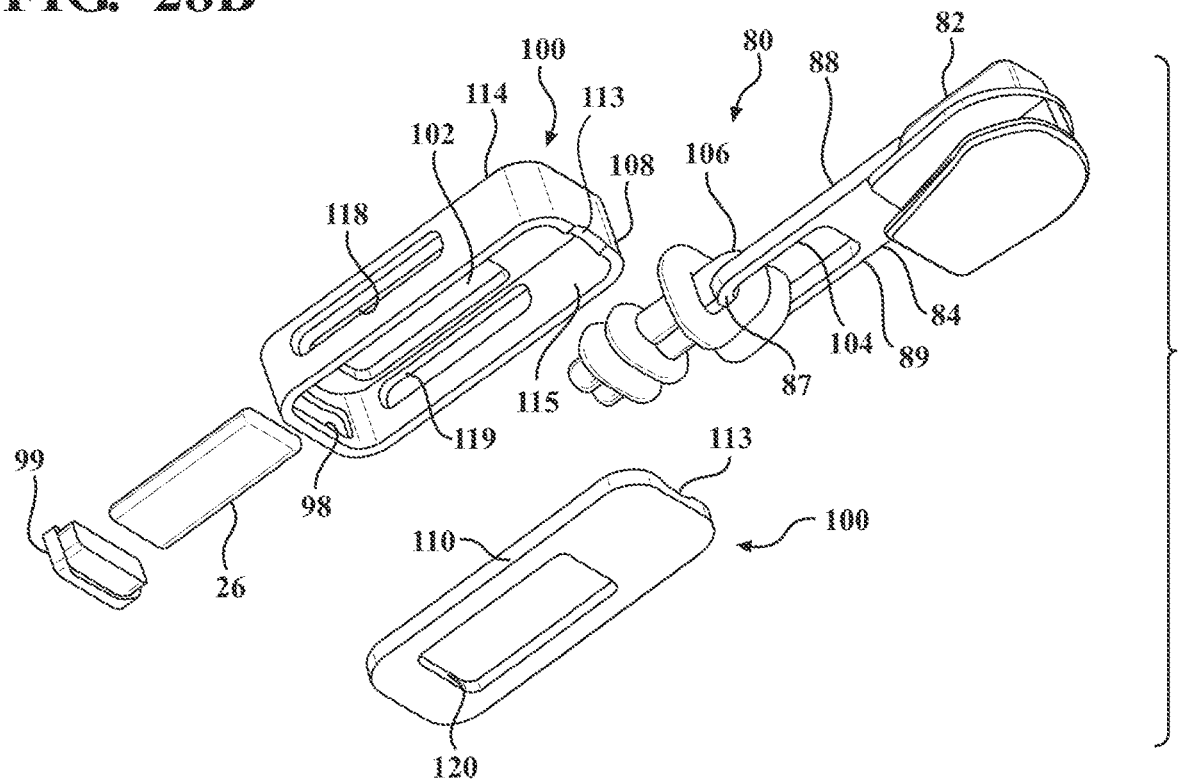
Figure 29:
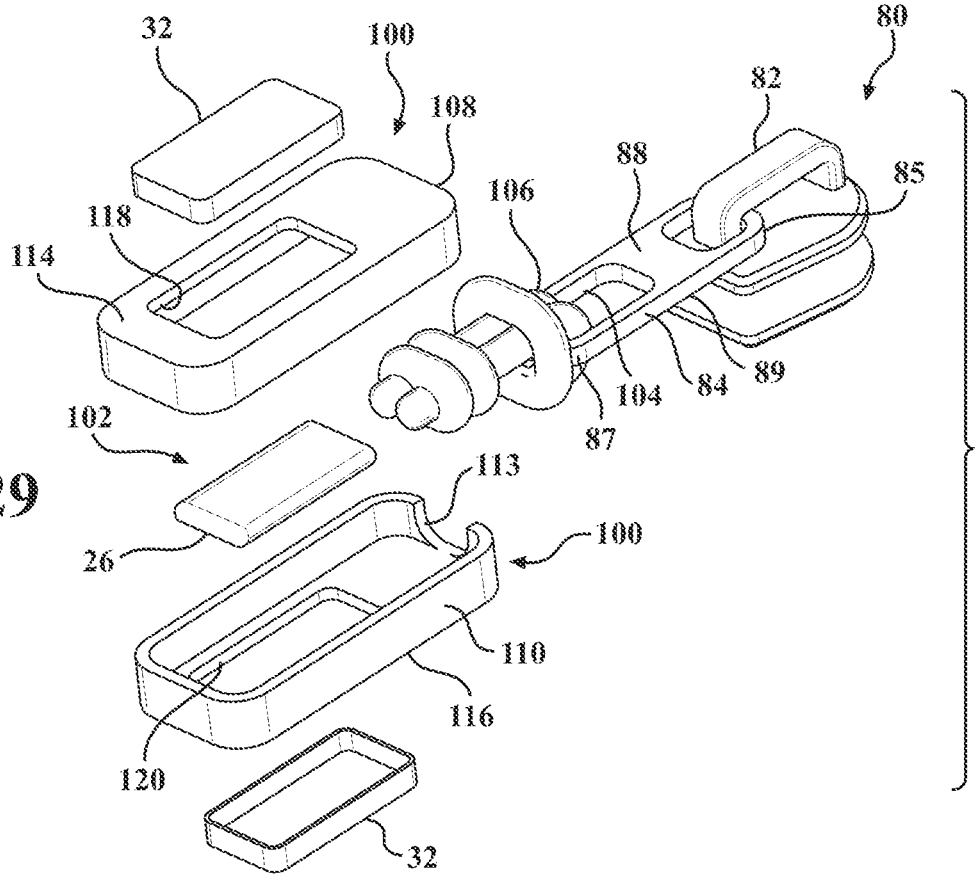
FIG. 29 is an exploded perspective view of the zipper assembly including the carrier assembly constructed in accordance with a sixth aspect for incorporating tritium.
Figure 30:
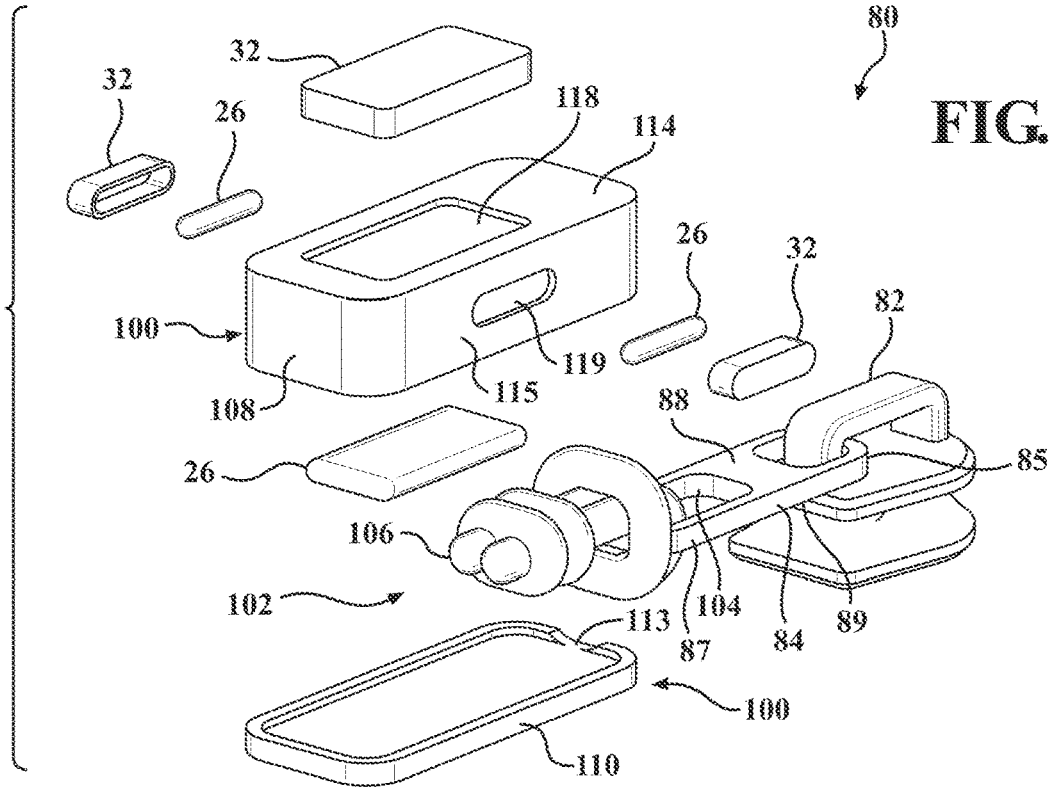
FIG. 30 is an exploded perspective view of the zipper assembly including the carrier assembly constructed in accordance with a seventh aspect for incorporating tritium.

As illustrated in FIGS. 28-30 and 35, when the tritium vial 26 is housed within the central carrier cavity 102 between the two clipped together components, the upper clip component 108 can define an upper viewport 118 along the upper clip surface 114 and/or a side viewport 119 along the side clip surface 115, each being open to the at least one carrier cavity 102. The lower clip component 110 can also define a lower viewport 120 and which is also open to the at least one carrier cavity 102 along the lower clip surface 116 for allowing the tritium illumination to be viewed from opposing sides of the pull 84, depending on its pivotable location relative to the slide 82. As illustrated in FIGS. 27, 29 and 31, a protective holder 32 can cover these upper and lower viewports 118, 120 to protect the tritium 26 housed within the carrier cavity 102. In a preferred arrangement, the protective holder 32 is comprised of transparent or translucent material, such as an injection molded plastic, for allowing illumination produced by the tritium vial 26 to be viewable by a user through the protective holder 32. However, the protective holder 32 could be comprised of other materials without departing from the scope of the subject disclosure.

As illustrated in FIGS. 24-26, 28A-B, 33 and 35, in accordance with another aspect, one of or collectively both of the upper and lower clip surfaces 114, 116 can define an end orifice 98 being open to and in communication with the carrier cavity 102 for allowing the tritium vial 26 to be passed through the end orifice 98 and into nested or embedded relationship within the clip-on carrier 100. As illustrated in FIGS. 28A-B, a cap 99 can be placed over the end orifice 98 to hold the tritium vial 26 within the carrier cavity 102. Alternatively, as illustrated in 24-25 and 33, a lens 34 can be micro-molded with the tritium vial 26 and be disposed in abutting relationship with the end orifice 98 to enclose the tritium vial 26 within the carrier cavity 102. The lens 34 can also be domed shape to project tritium illumination along multiple angles extending from the pull 84, and increase visibility of the tritium-illumination for a user of the zipper assembly 80.

Figure 32:
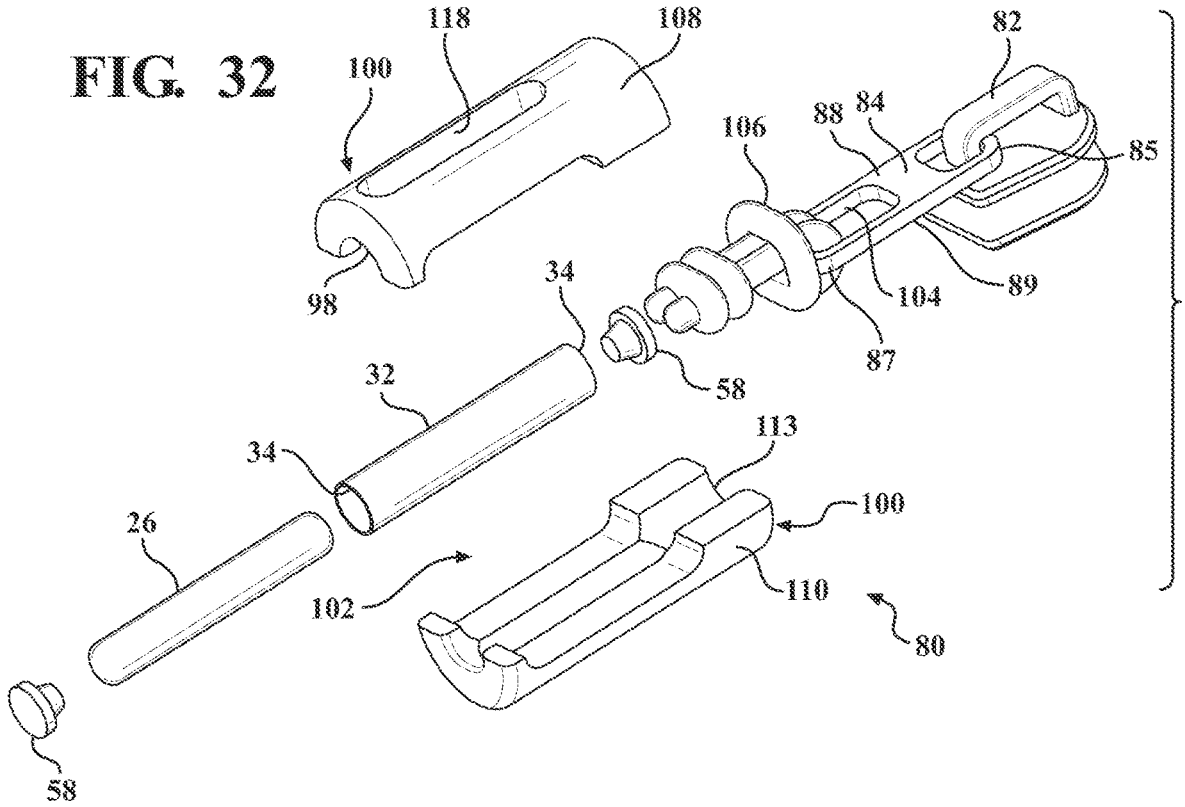
FIG. 32 is an exploded perspective view of the zipper assembly including the carrier assembly constructed in accordance with a ninth aspect for incorporating tritium.
Figure 33:
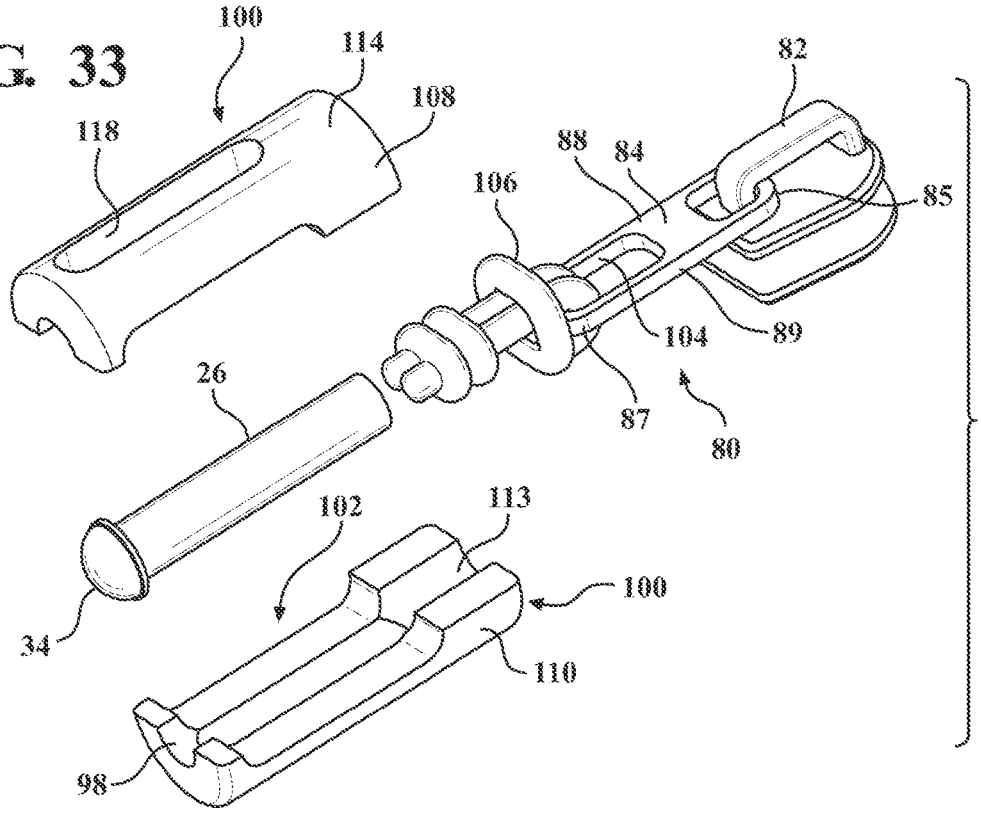
FIG. 33 is an exploded perspective view of the zipper assembly including the carrier assembly constructed in accordance with a tenth aspect for incorporating tritium.
Figure 34:
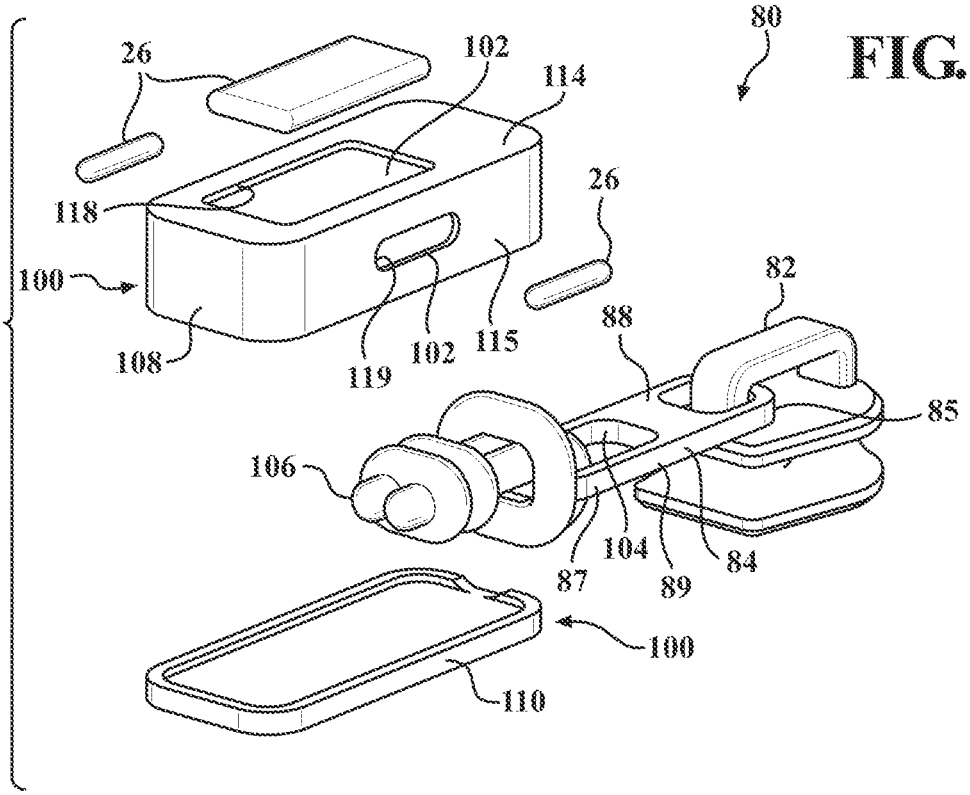
FIG. 34 is an exploded perspective view of the zipper assembly including the carrier assembly constructed in accordance with an eleventh aspect for incorporating tritium.
Figure 35:
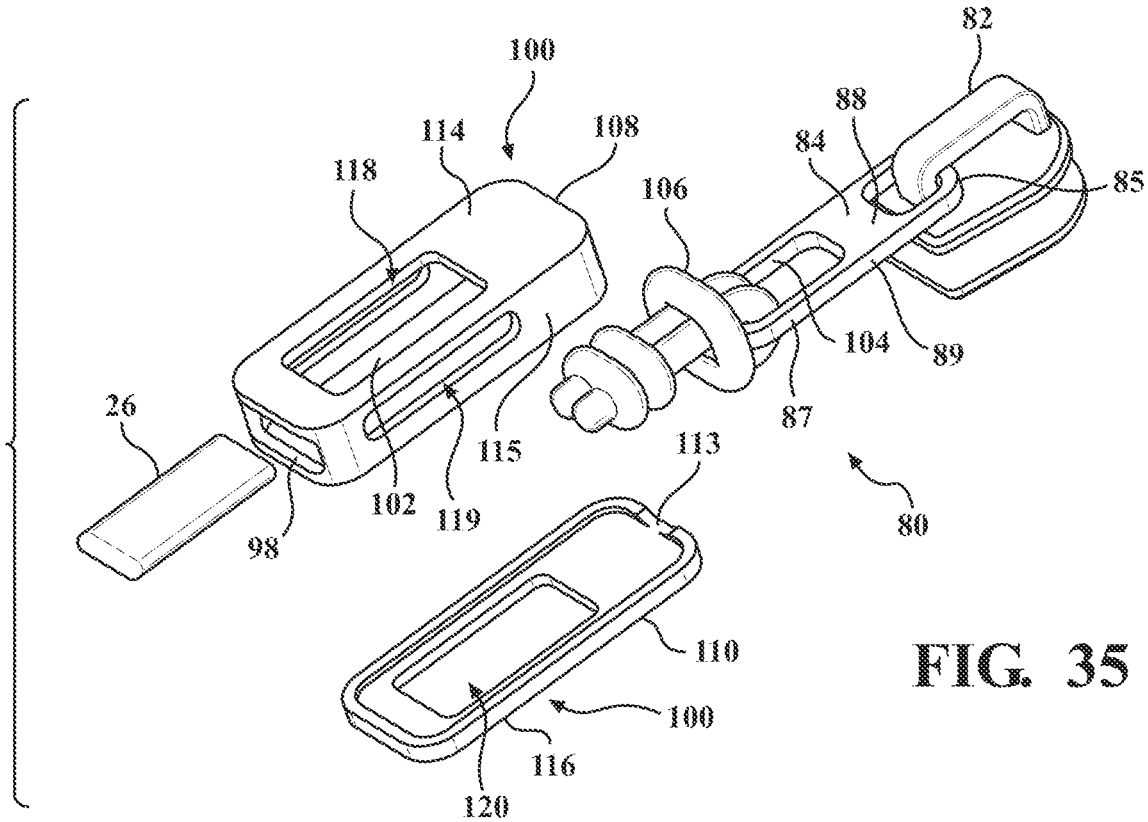
FIG. 35 is an exploded perspective view of the zipper assembly including the carrier assembly constructed in accordance with a twelfth aspect for incorporating tritium.

As illustrated in FIGS. 29-32, the at least one tritium vial 26 can be housed or secured within a protective holder 32 which is then inserted or embedded within the carrier cavity 102 to provide additional protection for the tritium vial(s) 26. As illustrated in FIG. 32, the protective holder 32 could even be arranged with a cylindrical shape for housing the tritium vial 26 between a pair of open cylindrical ends 34 that are covered with rubber stopper plugs 58, which is then inserted into the carrier cavity 102 through the end orifice 98. Arrangements of the protective holder 32 illustrated in FIGS. 21-23 are described in more detail in Paragraphs [0062-0065], and FIGS. 24-25, 28-29 and 33-35 of Applicant's U.S. application Ser. No. 17/832,836, the disclosure of which is incorporated herein by reference. However, as illustrated in FIGS. 24, 26 and 34-35, the tritium vial 26 could also be glued in the carrier cavity 102, with or without use of this protective holder 32.

As illustrated in FIG. 36, when the clip-on carrier assembly 100 is secured to the pull 84 via the carrier cord 101, the clip-on carrier assembly 100 can include a carrier body 122 extending from a first carrier end 124 to a second carrier end 126 to define an upper carrier body surface 128. The carrier body 122 can define the at least one carrier cavity 102 extending downwardly from the upper carrier body surface 128, and the tritium 26 is disposed within the carrier cavity 102. Although not expressly illustrated, the at least one carrier cavity 102 could also be defined by a lower carrier body surface or a side carrier body surface without departing from the scope of the subject disclosure. The carrier cord 101 extends from the first carrier end 124 such that the carrier cord 101 can be passed through the pull opening 104, after which the carrier body 122 is passed through an open end 130 of the carrier cord 101 to releasably secure the clip-on carrier assembly 100 and the tritium 26 housed therein to the pull 84.

As illustrated in FIG. 37, in an alternative arrangement of securing the clip-on carrier assembly 100 to the pull 84 via the carrier cord 101, the carrier body 122 can be cylindrically shaped between the first and second carrier ends 124, 126 to define a central carrier cavity 102 in which the tritium 26 is located. The tritium vial 26 can be housed or secured within a protective holder 32 which is then inserted through an end orifice 98 defined by the second carrier end 126 for embedding the protective holder 32 within the carrier cavity 102 to provide additional protection for the tritium vial(s) 26. The protective holder 32 can define a through-hole 132 which is aligned with a pair of fastener openings 134 defined by the carrier body 122 when the protective holder 32 is disposed within the carrier cavity 102. A pin 136 passes through the aligned through-hole 132 and fastener openings 134 to secure the protective holder 32 and the tritium 26 within the carrier cavity 102. Similar to the first arrangement, the carrier cord 101 extends from the first carrier end 124 such that the carrier cord 101 can be passed through the pull opening 104, after which the carrier body 122 is passed through an open end 130 of the carrier cord 101 to releasably secure the clip-on carrier assembly 100 and the tritium housed therein to the pull 84. However, although not expressly illustrated and as will be appreciated in view of the following disclosure, a shackle 103 could alternatively be connected to the pin 136 to secure the carrier body 122 to the pull 84.

As illustrated in FIG. 38, in an alternative arrangement, the clip-on carrier assembly 100 can be comprised of the protective body 32 which extends axially from a first protective body end 138 to a second protective body end 140. The carrier cavity 102 extends along the axis from the second protective body end 140 and the protective body 32 defines a through-hole 132 extending transverse to the axis adjacent the first protective body end 138. However, unlike the arrangement shown in FIG. 37, the protective body 32 is not arranged within a carrier body 122 but instead attached directly to the pull 84 via the shackle 103. More specifically, the shackle 103 includes a link 142, preferably u-shaped, that extends between a pair of link ends 144 each defining a link orifice 146. One of the link ends 144 can be passed through the pull opening 104 defined by the pull 84, after which the link orifices 146 are disposed in aligned relationship with the through-hole 132. The shackle 103 includes a pin 148 which passes through the aligned link orifices 146 and through-hole 132 and is secured to the link ends 144 to releasably secure the protective body 32 and the tritium 26 housed therein to the pull 84. In a preferred arrangement, the pin 148 is threaded on each end and a pair of screws 150 are threaded with the pin 148 to secure the shackle 103 to the protective body 32. However, other means of fastening could be utilized without departing from the scope of the subject disclosure.

As will be appreciated by the aforementioned disclosure, in any arrangement, the incorporation of at least one tritium vial 26 into the pull 84 provides aesthetic benefits to the zipper assembly 80 by illuminating the pull 84 and allowing a user to see the zipper assembly 80 at all times.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A zipper assembly comprising:

a slider for mating with and meshing together opposing teeth of a zipper;

a pull extending from a first end secured to said slider to a second pull end to define an upper pull surface and a lower pull surface disposed in spaced and opposing relationship with one another; and at least one tritium vial housed within or coupled to said pull for allowing illumination produced by said at least one tritium vial to highlight said pull and improve visibility of the zipper assembly, particularly in dark or low-light conditions.

2. The zipper assembly as set forth in claim 1, wherein said pull defines at least one pull cavity and said at least one tritium vial is housed within said at least one pull cavity.

3. The zipper assembly as set forth in claim 2, further comprising a protective holder disposed in said at least one pull cavity in overlaying relationship with said at least one tritium vial to embed and protect said at least one tritium vial from an environment of the zipper assembly.

4. The zipper assembly as set forth in claim 2, wherein said at least one pull cavity extends downwardly from said upper pull surface and/or upwardly from said lower pull surface.

5. The zipper assembly as set forth in claim 2, wherein said pull includes at least one side wall extending between said upper and lower pull surfaces and said at least one pull cavity extends inwardly from said side wall.

6. The zipper assembly as set forth in claim 2, wherein said at least one pull cavity extends between and generally parallel to said upper and lower pull surfaces and through a central portion of said pull from adjacent said first pull end to adjacent said second pull end.

7. The zipper assembly as set forth in claim 6, wherein said pull includes at least one side wall extending between said upper and lower pull surfaces, and at least one of said upper pull surface, said lower pull surface or said side wall defines a viewport being open to said at least one pull cavity for allowing tritium illumination to be viewable through said viewport.

8. The zipper assembly as set forth in claim 7, wherein said upper pull surface defines an upper viewport, said lower pull surface defines a lower viewport, and said side wall defines a side viewport for allowing the tritium illumination provided by said at least one tritium vial to be viewable by a user from multiple viewing angles of the zipper assembly.

9. The zipper assembly as set forth in claim 6, wherein said at least one tritium vial is housed within a protective housing having a cylindrical cross-sectional shape and extending within said at least one cavity between a pair of cylindrical ends covered with plugs to embed and protect said at least one tritium vial.

10. The zipper assembly as set forth in claim 9, further comprising:

said second pull end of said pull defining an end orifice disposed in open and aligned relationship with said at least one pull cavity for allowing said at least one tritium vial to be passed through said end orifice and into nested relationship within said pull; and a cap placed over said end orifice to hold said at least one tritium vial within said at least one cavity.

11. The zipper assembly as set forth in claim 1, further comprising:

a clip-on carrier assembly attached to said pull and defining at least one carrier cavity; and said at least one tritium vial housed within said at least one carrier cavity for establishing said coupled relationship of said at least one tritium vial to said pull.

12. The zipper assembly as set forth in claim 11, wherein said clip-on carrier assembly includes an upper clip component and a lower clip component which are releasably coupled to one another to establish said attached relationship of said clip-on carrier assembly to said pull.

13. The zipper assembly as set forth in claim 12, wherein said pull defines a pull opening extending between said upper and lower pull surfaces, and wherein one of said upper or lower clip components defines a male protrusion which passes through said pull opening and into mating relationship with a female depression defined by said other of said upper or lower clip component for securing said clip-on carrier assembly to said pull.

14. The zipper assembly as set forth in claim 12, wherein said pull defines a pull opening extending between said upper and lower pull surfaces, a zipper cord is wrapped around and through said pull opening, and said clip-on carrier assembly is releasably mated with said zipper cord to indirectly attach said clip-on carrier assembly to said pull.

15. The zipper assembly as set forth in claim 14, wherein said upper and lower clip components each define semi-circular recesses which collectively wrap around said zipper cord when said upper and lower clip components are releasably secured to one another.

16. The zipper assembly as set forth in claim 12, wherein said upper clip component defines said at least one carrier cavity extending downwardly from an upper clip surface and/or wherein said lower clip component defines said at least one cavity extending upwardly from a lower clip surface.

17. The zipper assembly as set forth in claim 16, further comprising a protective holder disposed in said at least one carrier cavity in overlaying relationship with said at least one tritium vial to embed and protect said at least one tritium vial from an environment of the zipper assembly.

18. The zipper assembly as set forth in claim 12, wherein said at least one cavity is defined by an area disposed between said upper and lower clip components, and wherein said upper clip component defines an upper viewport extending along an upper clip surface and/or said lower clip component defines a lower viewport extending along a lower clip surface.

19. The zipper assembly as set forth in claim 18, wherein a protective holder comprised of transparent or translucent material covers said upper and/or said lower viewport to protect said at least one tritium vial within said at least one carrier cavity.

20. The zipper assembly as set forth in claim 18, further comprising:

one of said upper or lower clip components defining an end orifice being open to and in communication with said at least one carrier cavity for allowing said at least one tritium vial to be passed through said end orifice and into nested relationship within said clip on carrier assembly; and a cap placed over said end orifice to hold said at least one tritium vial within said at least one carrier cavity.

* * * * *